US009996048B1

(12) United States Patent
Keniston et al.

(10) Patent No.: US 9,996,048 B1
(45) Date of Patent: Jun. 12, 2018

(54) IMAGING DEVICE ACCESS DOOR ASSEMBLY HAVING A LOW CLOSING FORCE

(71) Applicant: LEXMARK INTERNATIONAL, INC., Lexington, KY (US)

(72) Inventors: Matthew Ryan Keniston, Lexington, KY (US); Ryan Jay Alfonso Dumaquita, Mandaue (PH); Christopher Kent Washing, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days. days.

(21) Appl. No.: 15/488,552

(22) Filed: Apr. 17, 2017

(51) Int. Cl.

| | |
|---|---|
| ***G03G 21/16*** | (2006.01) |
| ***E05D 3/14*** | (2006.01) |
| ***E05D 11/10*** | (2006.01) |
| ***E05D 15/04*** | (2006.01) |

(52) U.S. Cl.
CPC ..... *G03G 21/1633* (2013.01); *E05D 3/14* (2013.01); *E05D 11/1007* (2013.01); *E05D 15/04* (2013.01); *E05Y 2900/606* (2013.01); *G03G 21/1623* (2013.01); *G03G 21/1638* (2013.01); *G03G 21/1647* (2013.01); *G03G 21/1695* (2013.01)

(58) Field of Classification Search
CPC ..... G03G 21/1623; G03G 21/1633; G03G 21/1638; G03G 21/1647; G03G 21/1695; G03G 2215/0067; G03G 2215/0154; G03G 2221/1651; G03G 2221/1654; G03G 2221/1675; G03G 2221/1684; G03G 2221/1687; G03G 2221/169; E05D 3/14; E05D 11/1007; E05D 15/04; E05Y 2900/606
See application file for complete search history.

(56) References Cited

U.S. PATENT DOCUMENTS

2008/0054771 A1* 3/2008 Brunnmayr ..... E05D 3/14 312/323
2011/0097131 A1* 4/2011 Ishida ..... B41J 11/14 400/611

* cited by examiner

*Primary Examiner* — Joseph S Wong

(57) ABSTRACT

An access door of an imaging device is movable between a raised closed position, a lowered open position, and a raised open position. A linkage assembly includes a lower link connected to the access door using a first revolute joint and an upper link connected to the access door using a compound joint. The compound joint is transformable between a prismatic joint and a second revolute joint, with the compound joint forming the prismatic joint as the access door moves between the raised closed position and the lowered open position and forming the second revolute joint as the access door moves between the lowered open position and the raised open position. The compound joint as the prismatic joint allows translational motion of the access door relative to the upper link. The compound joint as the second revolute joint allows rotational motion of the access door relative to the upper link.

20 Claims, 28 Drawing Sheets

IMAGING DEVICE ACCESS DOOR ASSEMBLY HAVING A LOW CLOSING FORCE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

Field of the Invention

The field relates generally to access doors for an imaging device having low closing force.

Description of the Related Art

In 1998, Congress amended the Rehabilitation Act of 1973 (29 U.S.C. § 794 (d)) to require Federal agencies to make their electronic and information technology accessible to people with disabilities. Section 508 of the Rehabilitation Act applies to all federal agencies when they develop, procure, maintain, or use electronic and information technology. Under Section 508, federal agencies must give disabled employees and members of the public access to information that is comparable to access available to others. These provisions apply to operable controls which are defined as components of a product that require physical contact for normal operation. Operable controls include, but are not limited to, access doors. Operable controls are to be operable with one hand and not require tight grasping, pinching, or twisting of the wrist. The force required to activate operable controls shall not be greater than a maximum of five pounds (22.2 N). Thus, under these requirements, the force needed to close or open an access door must not exceed 22.2 N.

Access doors for imaging devices are used to access customer replaceable units (CRUs) such as toner cartridges, waste toner bottles, fusers and the like. Typically, these CRUs are spring biased to allow for easy removal and also engage with internal components of the imaging device. This means that the access door enclosing CRUs must overcome the spring biasing and engagement forces in order to properly seat such CRUs in the imaging device so that the access door may be closed and latched in place. These forces also act on the access door during opening and need to be reduced so a customer opening the door does not experience them. In a color imaging device, such as a color electrophotographic printer, there are four color cartridges, cyan, magenta, yellow, and black cartridges or collectively, CMYK cartridges that are CRUs. These cartridges are accessed by users and must also be seated and engaged in the imaging device for proper operation. Each cartridge engages with corresponding mating components and drive components found in the imaging device. In some designs, each toner cartridge and its mating developer unit are individually shuttered to prevent toner leaking during installation and removal. When the access door is closed, both shutters are opened so that toner can transfer from the toner cartridge to the developer unit. Forces that bias closes the shutters act against the closure of the access door and are in the range of 2 to 2.5 pounds (8.88 to 11 N) per cartridge or about 8 to 10 pounds (35.5 to 44.4 N) for all four. In order to close the access door and open the shutters, the bias forces acting to close the shutters must be overcome. In addition, other forces such as friction in the hinges must also be overcome to close the access door and place the supplies items in a properly engaged state within the imaging device. However, the closing force on the access door to overcome these biasing forces is in excess of the 22.2 N force limit required under Section 508.

It would be advantageous to have an access door that may be opened and closed using a force no greater than 22.2 N.

SUMMARY OF THE INVENTION

Disclosed is an access door assembly of an imaging device having an access door movably mounted on a side of a housing of the imaging device. The access door is movable between a raised closed position and a lowered open position and between the lowered open position and a raised open position with the access door substantially covering an opening on the side of the housing when in the raised closed position, pivoted open about a pivot axis adjacent to a bottom edge thereof partially exposing an upper portion of the opening when in the lowered open position, and raised above the opening when in the raised open position. A linkage assembly is connected between the access door and the housing. The linkage assembly includes a lower link connected to the access door using a first revolute joint at a first attachment point and an upper link connected to the access door using a compound joint at a second attachment point above the first attachment point. The compound joint is transformable between a prismatic joint and a second revolute joint, with the compound joint forming the prismatic joint as the access door moves from the raised closed position to the lowered open position and forming the second revolute joint as the access door moves from the lowered open position to the raised open position. When the access door moves between the raised closed position and the lowered open position, the compound joint as the prismatic joint allows translational motion of the access door relative to the upper link at the second attachment point as the bottom edge of the access door rotates about the pivot axis defined by the first revolute joint at the first attachment point. When the access door moves between the lowered open position and the raised open position, the compound joint as the second revolute joint allows rotational motion of the access door relative to the upper link at the second attachment point as the access door rotates about the first revolute joint at the first attachment point of the lower link.

In another example embodiment, an imaging device includes a frame and a housing mounted on the frame and having an opening to receive one or more customer replaceable units. An access door is movably mounted on the frame for covering the opening. The access door is movable between a raised closed position and a lowered open position when respectively latching and unlatching the access door relative to the housing, and between the lowered open position and a raised open position when partially closing and fully opening the access door relative to the opening, respectively. The access door substantially covers the opening when in the raised closed position, is pivoted open about a pivot axis adjacent to a bottom edge thereof partially exposing an upper portion of the opening when in the lowered open position, and is raised above the opening when in the raised open position. A four-bar linkage is connected between the access door and the housing. The four-bar linkage includes a pair of lower links connected to the access door and having respective first revolute joints at respective first attachment points and a pair of upper links connected to the access door and having compound joints at respective second attachment points. Each compound joint is transformable between a prismatic joint and a second revolute joint as the access door moves between the raised closed position, the lowered open position, and the raised open position. When latching and unlatching the access door, the first revolute joints at the respective first attachment points define the pivot axis about which the access door pivots and each compound joint provides the prismatic joint to allow translational motion of the access door relative to the pair of upper links at the respective second attachment points as the access door moves between the raised closed position and the lowered open position. When fully opening and partially closing the access door relative to the opening, each compound joint provides the second revolute joint to allow rotational motion of the access door relative to the pair of upper links at the respective second attachment points as the access door moves between the lowered open position and the raised open position.

BRIEF DESCRIPTION OF THE DRAWINGS

The above-mentioned and other features and advantages of this present disclosure, and the manner of attaining them, will become more apparent and the present disclosure will be better understood by reference to the following description of embodiments of the present disclosure taken in conjunction with the accompanying drawings.

DETAILED DESCRIPTION

Figure 1:
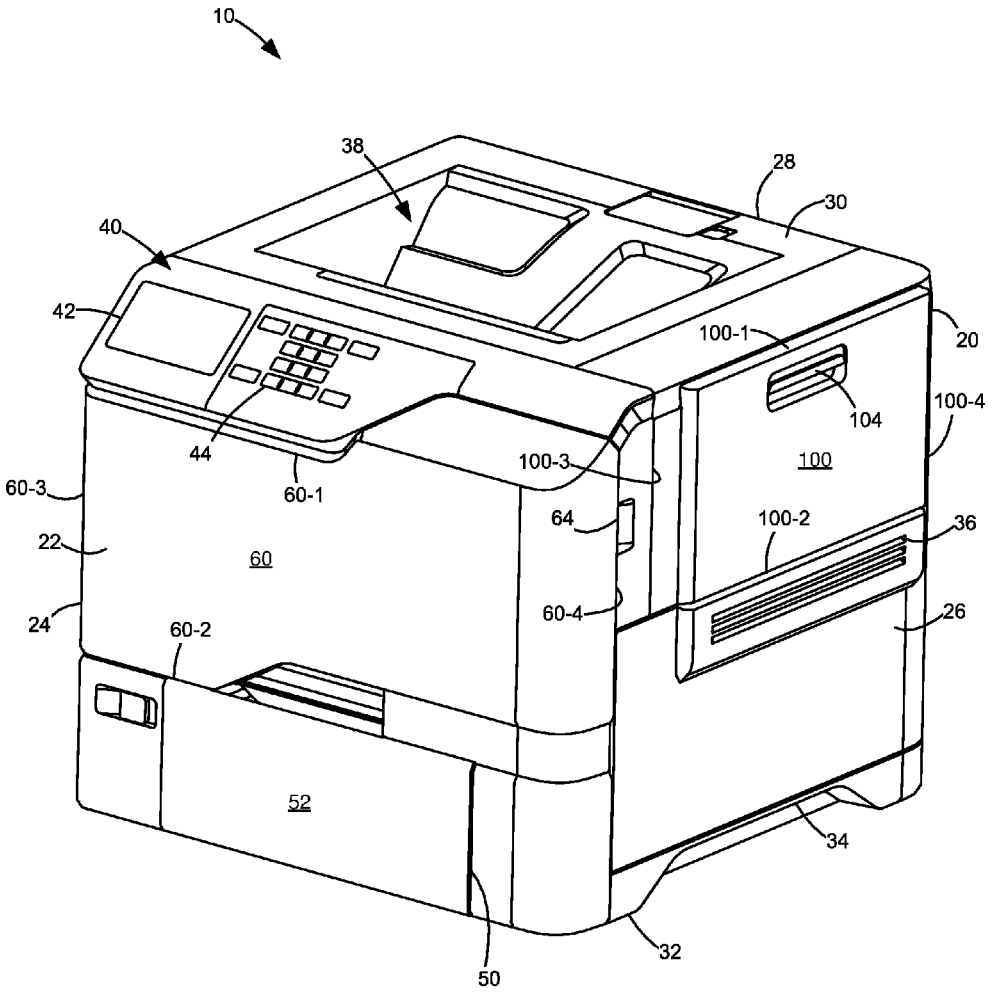
FIGS. 1-4 are illustrations of an imaging device having a side access door in a raised closed position, a lowered open position, a partially-raised open position, and a fully-raised open position, respectively, according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the handle of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device.

FIGS. 1-4 illustrate an example imaging device 10. Imaging device 10 has a housing 20 having a front 22, a first side 24, a second side 26, a rear 28, a top 30 and a bottom 32 and into which a removable media tray 50 is slidably inserted. A user interface 40 comprising a display 42 and a key panel 44 may be located on the front 22 of housing 20. Using the user interface 40, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A media output area 38 for receiving printed media is provided in the top 30. A multipurpose input tray 52 folds out from the front of the removable media tray 50 and may be used for handling envelopes, index cards or other media for which only a small number of media will be printed. The multipurpose input tray 52 may also be incorporated into front 22 of housing 20 rather than being incorporated into removable media tray 50. Hand grips 34 are provided in several locations on housing 20 such as on sides 24, 26. Also, ventilation openings, such as vent 36, are provided on imaging device 10 such as those shown on second side 26.

A front access door 60 is mounted on the front 22 of imaging device 10. Front access door 60 has a top edge 60-1, a bottom edge 60-2, a left edge 60-3, and a right edge 60-4. A side access door 100 is provided on the second side 26 of imaging device 10. Side access door 100 has a top edge 100-1, a bottom edge 100-2, a left or front edge 100-3, and a right or rear edge 100-4. Access door release handles 64, 104 are provided near top edges 60-1, 100-1 and are used to open front and side access doors 60, 100, respectively, to allow user access into the interior of imaging device 10. Door release handle 104 actuates a latching system provided on the interior of side access door 100.

Figure 2:
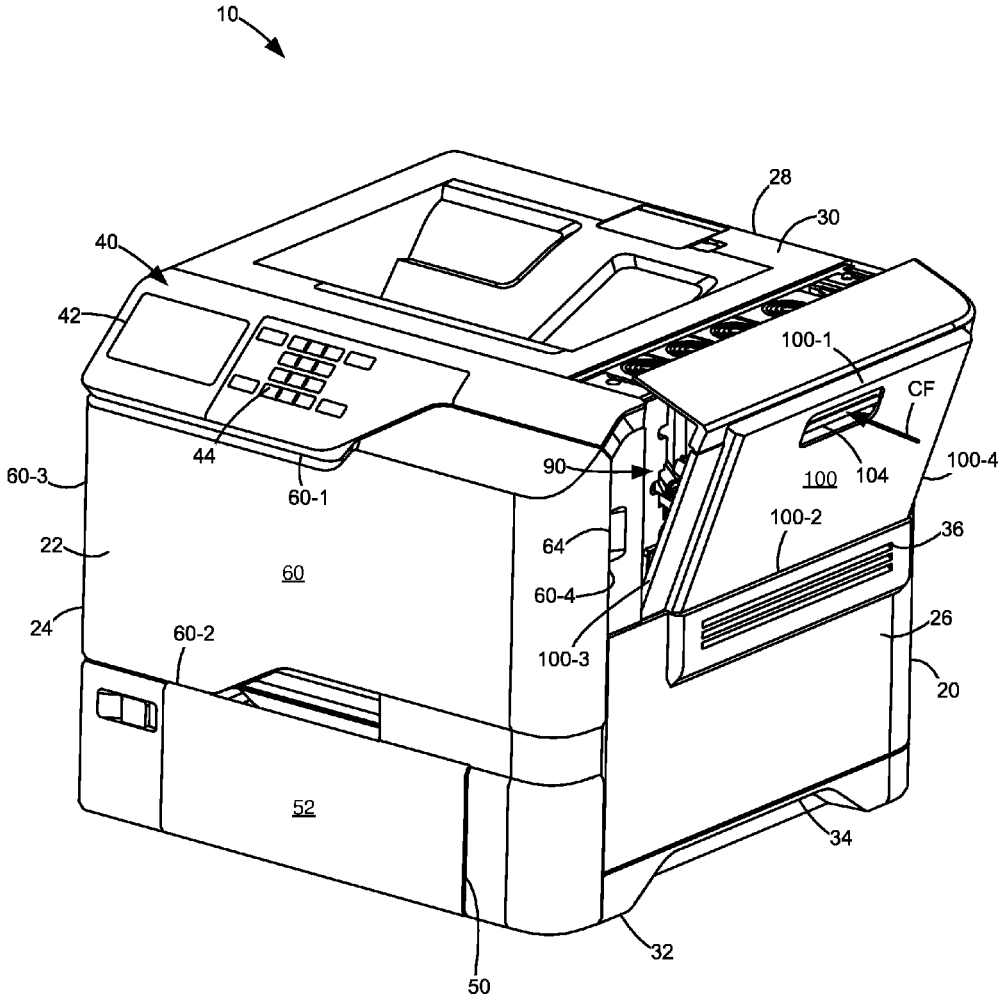
Figure 3:
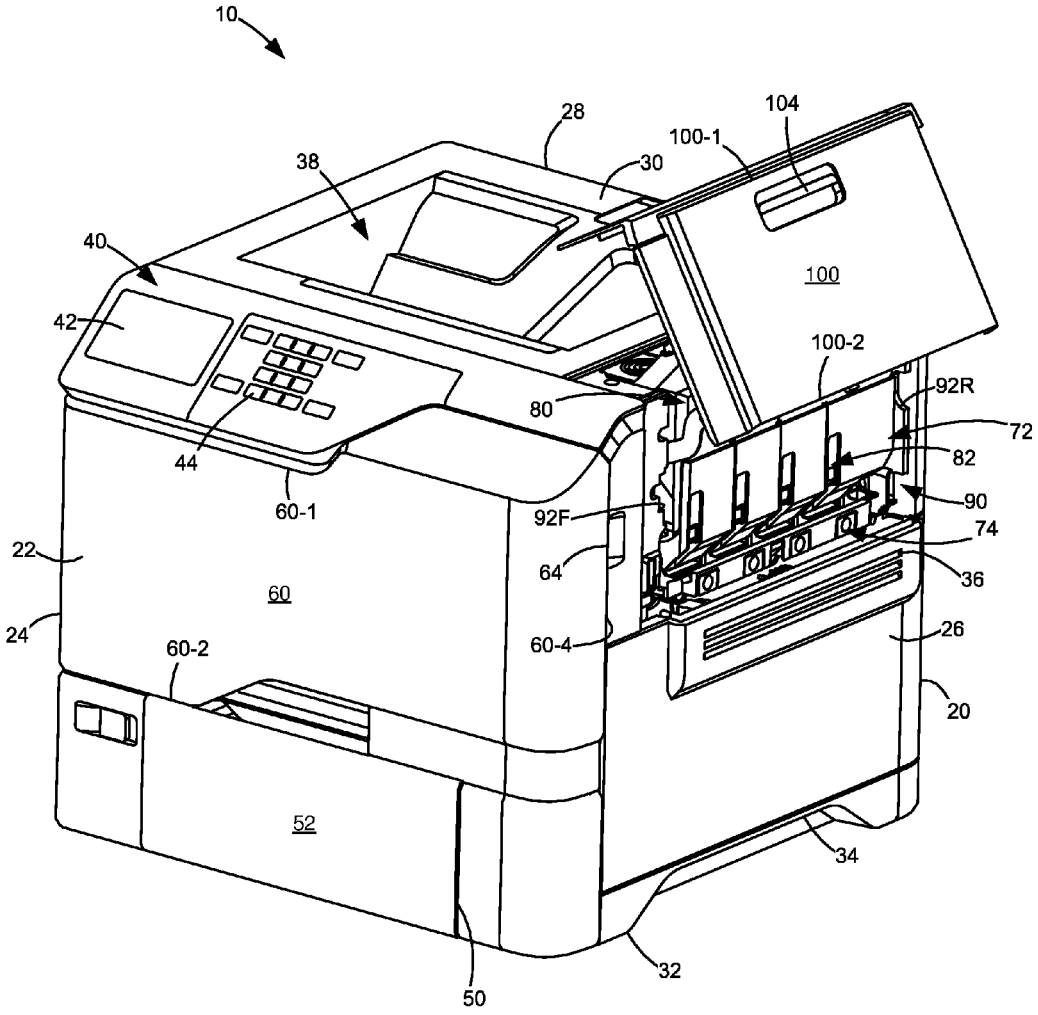
Figure 4:
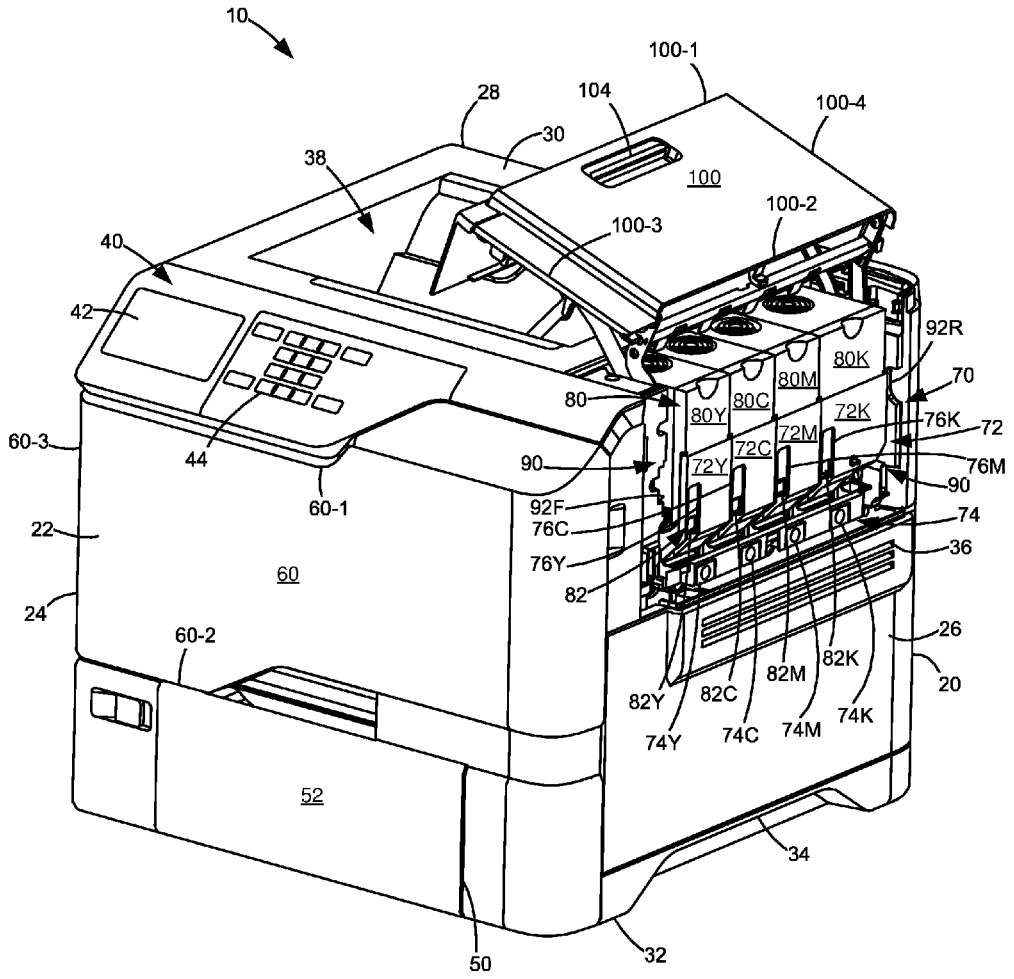

Side access door 100 is shown in a raised closed position in FIG. 1, in a lowered open position in FIG. 2, in a partially-raised open position in FIG. 3, and in a fully-raised open position in FIG. 4. Hereinafter, reference to a raised open position of side access door 100 refers to its fully-raised open position shown in FIG. 4. In the raised closed position, side access door 100 substantially covers an opening 90 and forms part of second side 26 of housing 20. In the lowered open position, side access door 100 is pivoted open about a pivot axis adjacent its bottom edge 100-2 partially exposing an upper portion of opening 90. In the raised open position, side access door 100 is raised above opening 90 and over the top 30 of imaging device 10 allowing full access to interior components disposed within opening 90. An access door latch (not shown), which is coupled to door release handle 104 for actuation thereby, is provided on the inner surface 100-5 (see FIG. 5A) near top edge 100-1 of side access door 100 and is used to hold side access door 100 in its raised closed position. In one example, the access door latch may be comprised of a mechanical latch, such as a hook feature that engages with a corresponding latch on housing 20, or other latching mechanisms known in the art.

The interior of imaging device 10 may contain a number of detachable consumer replaceable units (CRUs) accessible via side access door 100. In the example embodiment shown in FIG. 4, imaging device 10 includes a carriage assembly 70 disposed within opening 90 and including four cradles 72C, 72M, 72Y, 72K and generally designated 72 configured to hold toner cartridges 80C, 80M, 80Y, 80K and generally designated as 80, respectively, for use in an imaging operation. Each of the toner cartridges 80C, 80M, 80Y, 80K corresponds to a particular ink color, i.e., cyan, magenta, yellow, and black, respectively. Each cradle 72 includes a cartridge storage area sized and shaped to receive and hold a corresponding toner cartridge 80, and is independently pivotable between a loading position (see FIG. 11) in which cradle 72 is tilted outwardly out of opening 90 for receiving a toner cartridge 80 and an operating position in which cradle 72 is pivoted inwardly into opening 90, as shown in FIG. 4, after installing toner cartridge 80. Each cradle 72 is biased toward the loading position shown in FIG. 11 such as, for example, by a compression or torsion spring (not shown).

The insertion of a toner cartridge 80 into a corresponding cradle 72 of carriage assembly 70 will now be briefly described. When cradle 72 is in the loading position (FIG. 11), it is angled outwardly such that a toner cartridge 80 may be slid into the cartridge storage area of cradle 72 from above by the user. Gravity guides toner cartridge 80 downward until it is fully seated (see FIG. 11). Once toner cartridge 80 is fully seated in cradle 72, a user is able to pivot cradle 72 having toner cartridge 80 therein forward from the loading position to the operating position (FIG. 4). As cradle 72 pivots forward from the loading position to the operating position with toner cartridge 80 installed therein, the interface features of toner cartridge 80 mate with their corresponding interface features inside of imaging device 10. For example, as cradle 72 pivots forward, an outlet port of toner cartridge 80 mates with an inlet port of a corresponding developer unit (not shown) so that toner may transfer from toner cartridge 80 to the mating developer unit. A latch assembly (not shown) is used to removably affix toner cartridge 80 to carriage assembly 70 in the operating position. With side access door 100 in the raised open position, a user may remove a particular toner cartridge 80 by pressing a release button 74 of the latch assembly associated with cradle 72 holding the toner cartridge 80. Pressing release button 74 unlatches toner cartridge 80 causing cradle 72 to rotate from the operating position to the loading position and allowing cradle 72 and toner cartridge 80 to be angled toward side access door 100 presenting toner cartridge 80 to the user for removal. Release buttons 74C, 74M, 74Y, 74K are provided for cradles 72C, 72M, 72Y, 72K, respectively, providing for the individual installation and/or removal of toner cartridges 80C, 80M, 80Y, 80K.

Figure 5A:
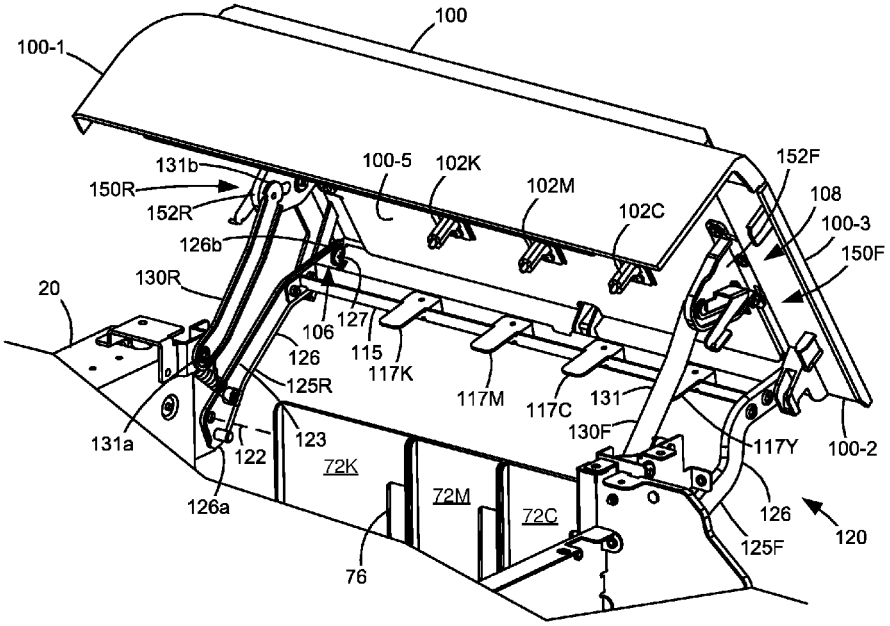
FIGS. 5A-5B are left and right side perspective illustrations of the side access door with a linkage assembly having an example embodiment of compound joint connections of the present disclosure.
Figure 5B:
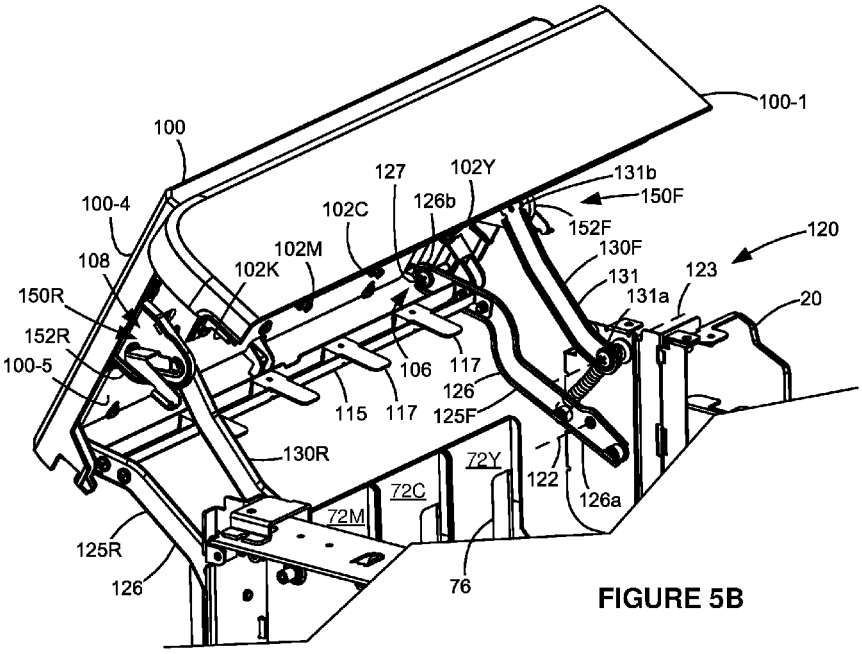
Figure 6:
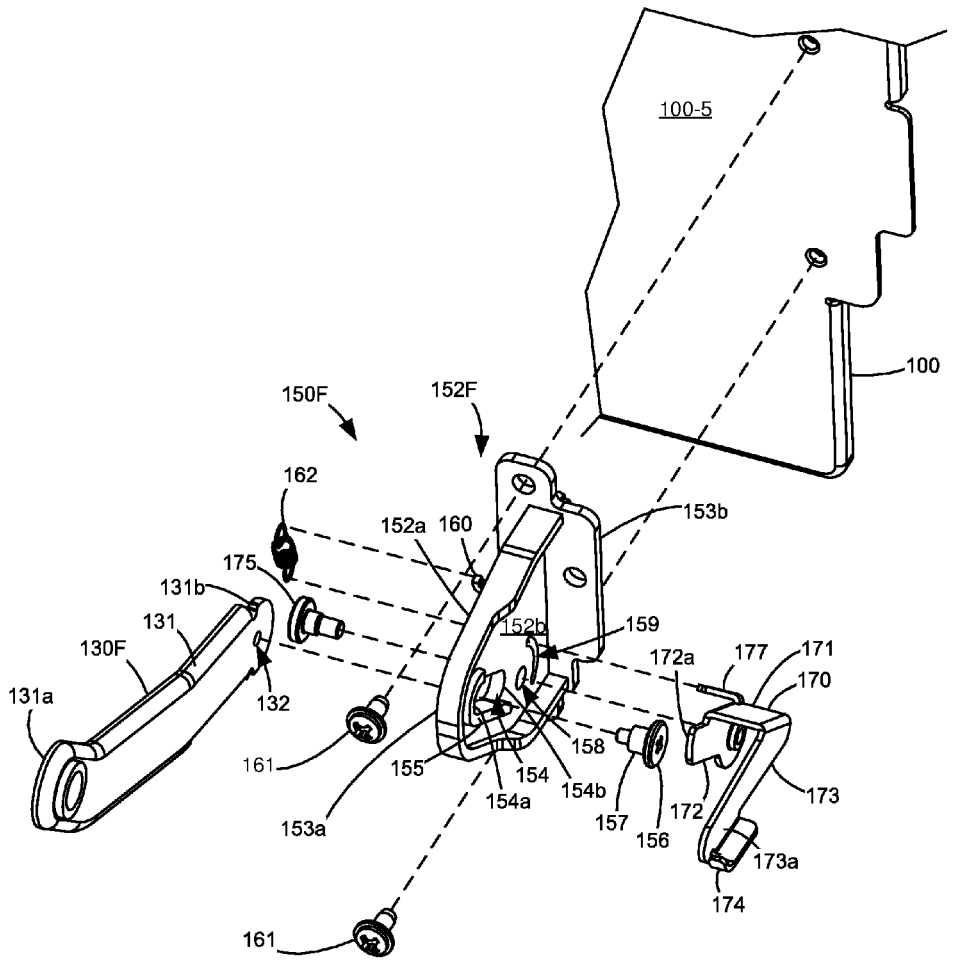
FIG. 6 is an exploded perspective view of the example embodiment of a compound joint connection of FIGS. 5A-5B.

In an example embodiment, each of toner cartridges 80C, 80M, 80Y, 80K also includes an engagement member, such as respective plungers 82C, 82M, 82Y, 82K, generally designated with reference numeral 82, that is positioned to concurrently open a port shutter of the corresponding toner cartridge 80C, 80M 80Y, 80K and a shutter on the mating developer unit when side access door 100 is closed. With reference to FIGS. 5A-5B, side access door 100 includes a plurality of actuation fingers 102C, 102M, 102Y, 102K mounted on the inner surface 100-5 thereof for actuating respective plungers 82C, 82M, 82Y, 82K of respective toner cartridges 80C, 80M, 80Y, 80K. When side access door 100 is in its raised closed position, actuation fingers 102C, 102M, 102Y, 102K are aligned with corresponding openings 76C, 76M, 76Y, 76K of cradles 72C, 72M, 73Y, 72K for passage therethrough to engage with corresponding plungers 82C, 82M, 82Y, 82K. Each plunger 82 exerts a force F on the corresponding actuation finger 102 actuating the plunger 82 when side access door is moved from the lowered open position to the raised closed position. Given that there are four toner cartridges 80C, 80M, 80Y, 80K, a total force exerted by the four plungers 82C, 82M, 82Y, 82K on respective actuation fingers 102C, 102M, 102Y, 102K would be up to four times the force F, which contributes to the overall force resisting the closure of side access door 100 in addition to any forces imparted by the latching system on side access door 100, friction in the hinges, or other sources of resistive force inherent to a typical access door design.

A four-bar linkage assembly 120 according to an example embodiment is provided between housing 20 of imaging device 10 and side access door 100 that allows a user to provide less than 22.2 N of force to close side access door 100 from lowered open position to the raised closed position. In the example embodiment illustrated in FIGS. 5A, 5B, linkage assembly 120 is generally a four-bar mechanism including a pair of lower links 125F, 125R and a pair of upper links 130F, 130R connected between side access door 100 and housing 20.

Linkage assembly 120 allows for a two-step operation of side access door 100 when opening or closing side access door 100 relative to opening 90. Side access door 100 is unlatched by actuating door release handle 104 and rotating side access door 100 about a pivot axis adjacent its bottom edge 100-2 from the raised closed position (FIG. 1) to the lowered open position (FIG. 2). In one example, side access door 100 rotates about 20 degrees between its raised closed position and lowered open position. From the lowered open position, side access door 100 may be lifted and rotated upward until side access door 100 comes to rest over the top 30 of imaging device 10 in the raised open position (FIG. 4). Conversely, from the raised open position, side access door 100 may be rotated downward and lowered until it reaches the lowered open position. Thereafter, side access door 100 may be rotated about the pivot axis adjacent its bottom edge 100-2 toward opening 90 until it is latched in the raised closed position. The two-step closing/opening operation of side access door 100 allows for a decrease in area needed at the side of imaging device 10 for toner cartridge replacement. In addition, the likelihood of door breakage due to incidental contact with the side access door hanging downward/outward from the printer is reduced.

For ease of description, pivotal motion of side access door 100 between the raised closed position and lowered open position is hereinafter referred to as latching or unlatching motion of side access door 100 with the unlatching motion referring to movement of side access door 100 from the raised closed position to the lowered open position and the latching motion referring to the reverse movement thereof from the lowered open position to the raised closed position. On the other hand, lifting and lowering motion of side access door 100 between the lowered open position and the raised open position is hereinafter referred to as opening or closing motion of side access door 100 with the opening motion referring to movement of side access door 100 from the lowered open position to the raised open position and the closing motion referring to the reverse movement thereof from the raised open position to the lowered open position.

During opening motion of side access door 100, linkage assembly 120 allows side access door 100 to be lifted out of the toner cartridge access space and remain out of the way without the need for a user to hold it up to allow replacement of toner cartridges, waste toner bottle, developer unit, photoconductive unit, and other internal components. When side access door 100 is in the raised open position, it remains in a position that lowers the possibility of damage due to user carelessness or inattention. In addition, the four-bar linkage allows for the opening and closing motion of side access door 100 that swings through a smaller volume than a simple pivot door would.

Each of lower links 125F, 125R includes an arm portion 126 having a first end 126*a* rotatably attached to housing 20 about a pivot axis 122, and a second end 126*b* connected to side access door 100 using a first revolute joint 127 at a first attachment point 106 to allow rotational motion of side access door 100 relative to lower link 125F, 125R when moving side access door 100. Each of upper links 130F, 130R includes an arm portion 131 having a first end 131*a* rotatably attached to housing 20 about a pivot axis 123, and a second end 131*b* connected to side access door 100 using a compound joint 150 at a second attachment point 108 above the first attachment point 106. In an example embodiment, each compound joint 150F, 150R is transformable between a prismatic joint and a revolute joint as side access door 100 moves between the raised closed position, the lowered open position, and the raised open position. In particular, each compound joint 150F, 150R forms the prismatic joint as side access door 100 moves between the raised closed position and the lowered open position during latching or unlatching motion thereof, and forms the second revolute joint as side access door 100 moves between the lowered open position and the raised open position during opening or closing motion thereof. When side access door 100 moves between the raised closed position and the lowered open position, compound joints 150F, 150R as prismatic joints allow translational motion of side access door 100 relative to upper links 130F, 130R at the respective second attachment points 108 as the bottom edge 100-2 of side access door 100 rotates about the pivot axis defined by the first revolute joints 127 at the respective first attachment points 106. When side access door 100 moves between the lowered open position and the raised open position, compound joints 150F, 150R as second revolute joints allow rotational motion of side access door 100 relative to upper links 130F, 130R at the respective second attachment points 108 as side access door 100 rotates about the first revolute joints 127 of lower links 125F, 125R at the respective first attachment points 106.

Details of compound joint 150F, 150R are illustrated in FIGS. 6-8B. Because both compound joints 150F, 150R are similar, only compound joint 150F is shown in FIGS. 6-8B. As seen in FIG. 5A, the inner surface 100-5 of side access door 100 is provided with a pair of aligned spaced apart mounts 152F, 152R adjacent opposite sides 100-3, 100-4 of side access door 100, respectively. Mounts 152F, 152R each comprise a base 153*b* having an arm 153*a* depending therefrom. An elongated slot 154 is formed in arm 153*a* with elongated slot 154 having a first end portion 154*a* and a second end portion 154*b*. Mounts 152F, 152R are secured to inner surface 100-5 of side access door 100 by fasteners 161. A shoulder screw 156 includes a slide pin 157 that passes through the elongated slot 154 and operatively couples with the second end 131*b* of upper link 130F via an opening 132 such that slide pin 157, together with the second end 131*b* of upper link 130, is movable along the elongated slot 154. A U-shaped actuator arm 170 is pivotally attached to mount 152F. A fastener 175 is used to pivotally attach actuator arm 170 to mount 152F via an opening 158 formed therethrough. Actuator arm 170 includes a base 171 having a first arm portion 172 having a free end 172*a* and a longer second arm portion 173 having a free end 173*a* depending from base 171. A cam surface 174 is provided at free end 173*a* of second arm portion 173 and is arranged to contact against a corresponding guide surface 92F, 92R (See FIGS. 3 and 4) on housing 20 located at opposite sides of opening 90 during latching and unlatching motion of side access door 100. In the example shown, each of guide surfaces 92F, 92R has a generally C-shaped profile, such as having a curved lower portion, a vertical middle portion, and a horizontal top portion, to assist in the operation of compound joints 150F, 150R. A spring post 160 is provided on an inner side 152*a* of arm 153*a* and a hook arm 177 extends from actuator arm 170 through a curved guide slot 159 formed on arm 153*a* of mount 152F. A bias spring 162 is connected between hook arm 177 and spring post 160 so as to continuously bias actuator arm 170 to rotate in a direction that rotates free end 172*a* of first arm portion 172 towards elongated slot 154. When cam surface 174 of second arm portion 173 is unobstructed, such as by guide surface 92, bias spring 162 rotates actuator arm 170 such that first arm portion 172 rests on a ledge 155 projecting from an outer side 152*b* of arm 153*a* along at least a portion of a perimeter of elongated slot 154, as shown in FIG. 8A.

Figure 7A:
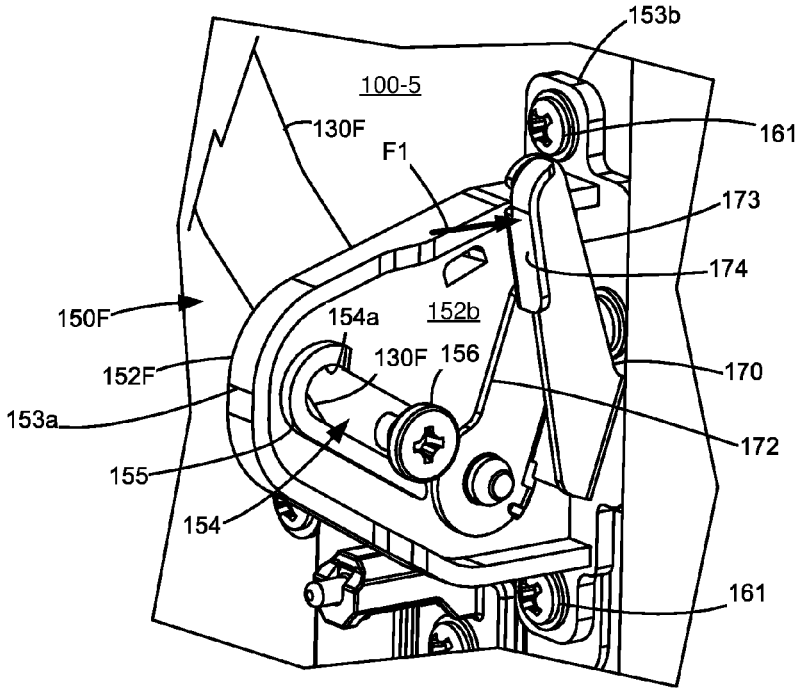
FIGS. 7A-7B are left and right side perspective illustrations of the example embodiment of a compound joint connection of FIG. 6 when the side access door is in the raised closed position.
Figure 7B:
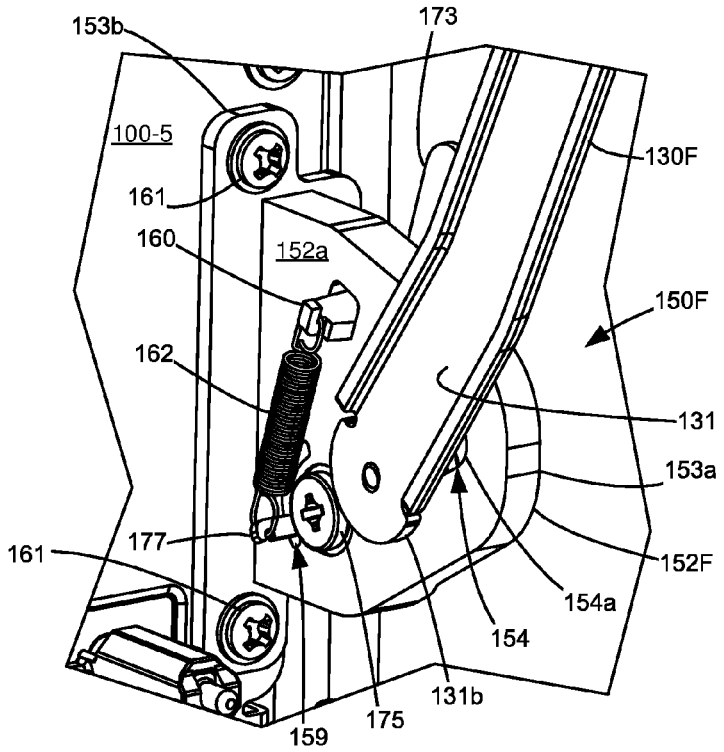
Figure 8A:
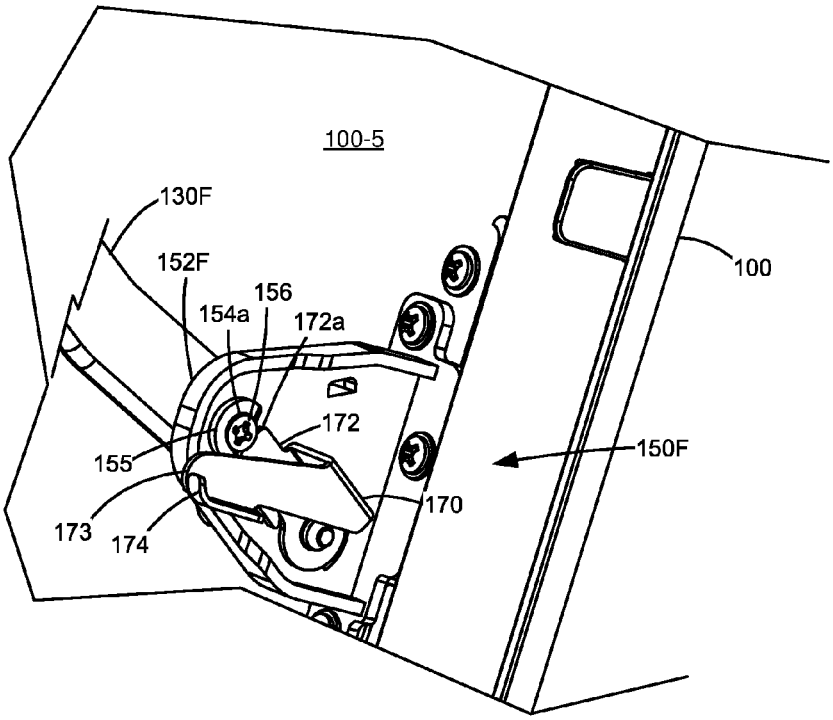
FIGS. 8A-8B are left and right side perspective illustrations of the example embodiment of a compound joint connection of FIG. 6 when side access door is in the lowered open position.
Figure 8B:
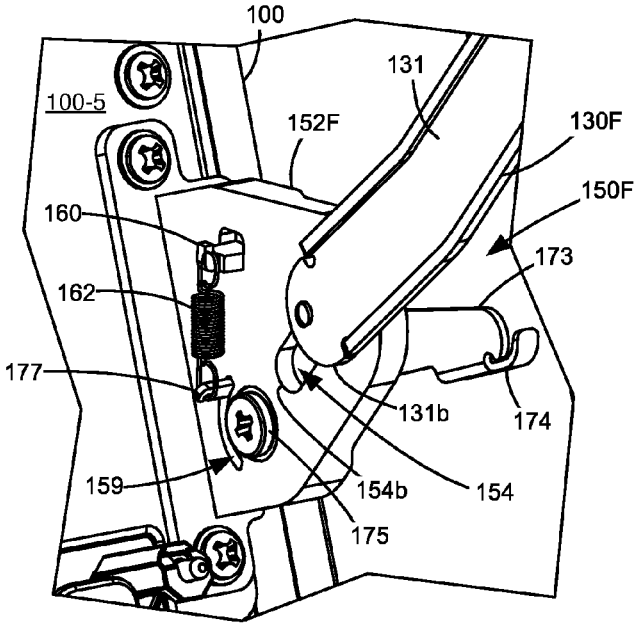

In FIGS. 7A-7B, shoulder screw 156 is shown positioned at second end portion 154*b* of elongated slot 154 with actuator arm 170 rotated away from ledge 155 when a force F1 is applied to cam surface 174 by guide surface 92 counter to and overcoming the biasing force of bias spring 162. Since first arm portion 172 of actuator arm 170 is rotated away from elongated slot 154, shoulder screw 156 is free to move along elongated slot 154 allowing for compound joint 150F to form the prismatic joint which facilitates translational motion of side access door 100 relative to upper link 130F. In FIGS. 8A-8B, shoulder screw 156 is shown positioned at first end portion 154*a* of elongated slot 154 with actuator arm 170 rotated by bias spring 162 in the counter-clockwise direction, as viewed in FIG. 8A, such that first arm portion 172 abuts ledge 155 and its free end 172*a* abuts and locks shoulder screw 156 at the first end portion 154*a* of elongated slot 154. In this position, shoulder screw 156 is prevented by first arm portion 172 from translating along elongated slot 154 allowing for compound joint 150F to form the second revolute joint at the first end portion 154*a* of elongated slot 154 which facilitates rotational motion of side access door 100 about an axis defined by shoulder screw 156 without shoulder screw 156 moving along elongated slot 154. Accordingly, actuator arm 170 provides a locking mechanism that locks out linear motion of shoulder screw 156 along elongated slot 154 to form the second revolute joint and unblocks linear motion of shoulder screw 156 along elongated slot 154 to form the prismatic joint.

With reference to FIGS. 9A-10D, operation of compound joints 150F, 150R during movement of side access door 100 will be described. Because both compound joints 150F, 150R operate in the same manner, only compound joint 150F is shown in FIGS. 9A-10D. FIGS. 9A-9D are sequential front views illustrating the unlatching and opening motion of side access door 100, and FIGS. 10A-10D are corresponding sequential rear views of FIGS. 9A-9D, respectively. Further, it is noted that although lower links 125F, 125R have different shapes, they both operate in a similar manner.

Figure 9A:
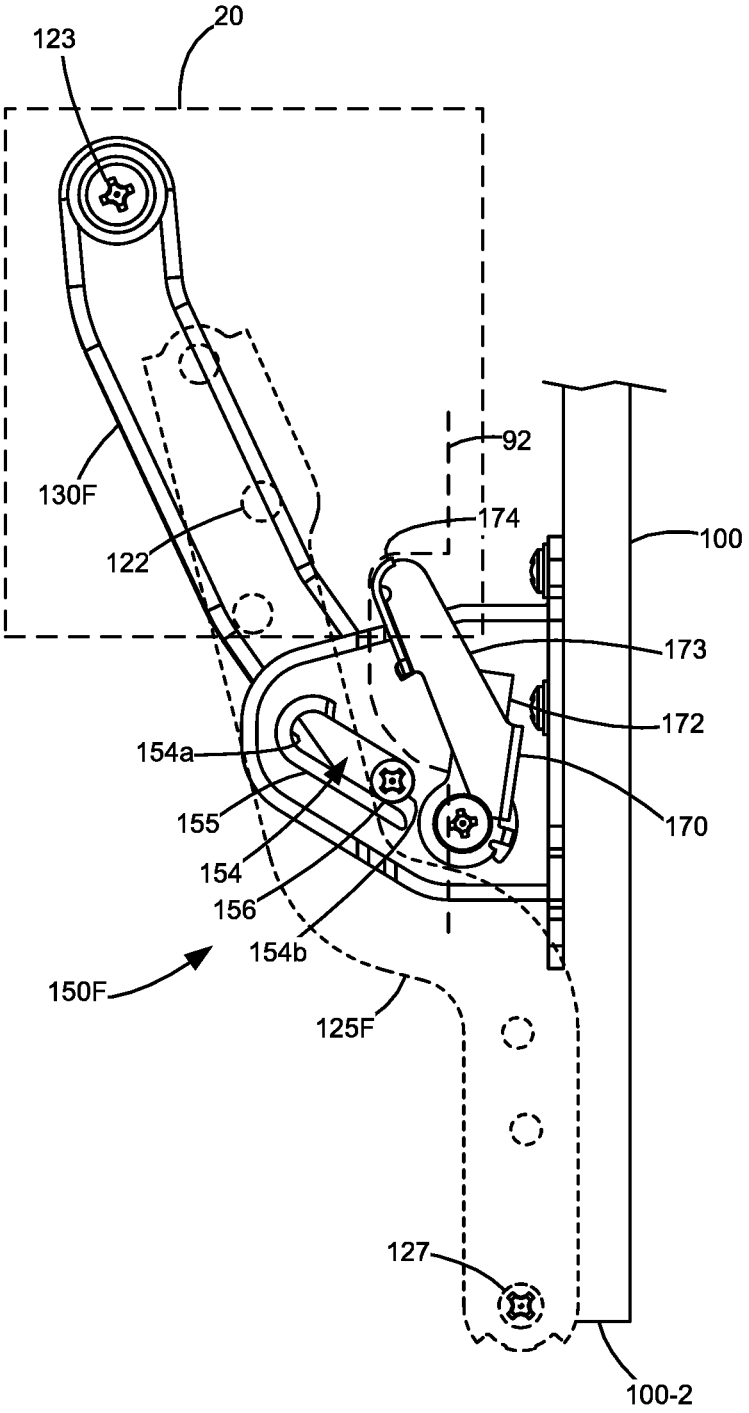
FIGS. 9A-9D are sequential front views illustrating the operation of the linkage assembly and the example embodiment of a compound joint connection of FIG. 6 when opening the side access door.
Figure 9B:
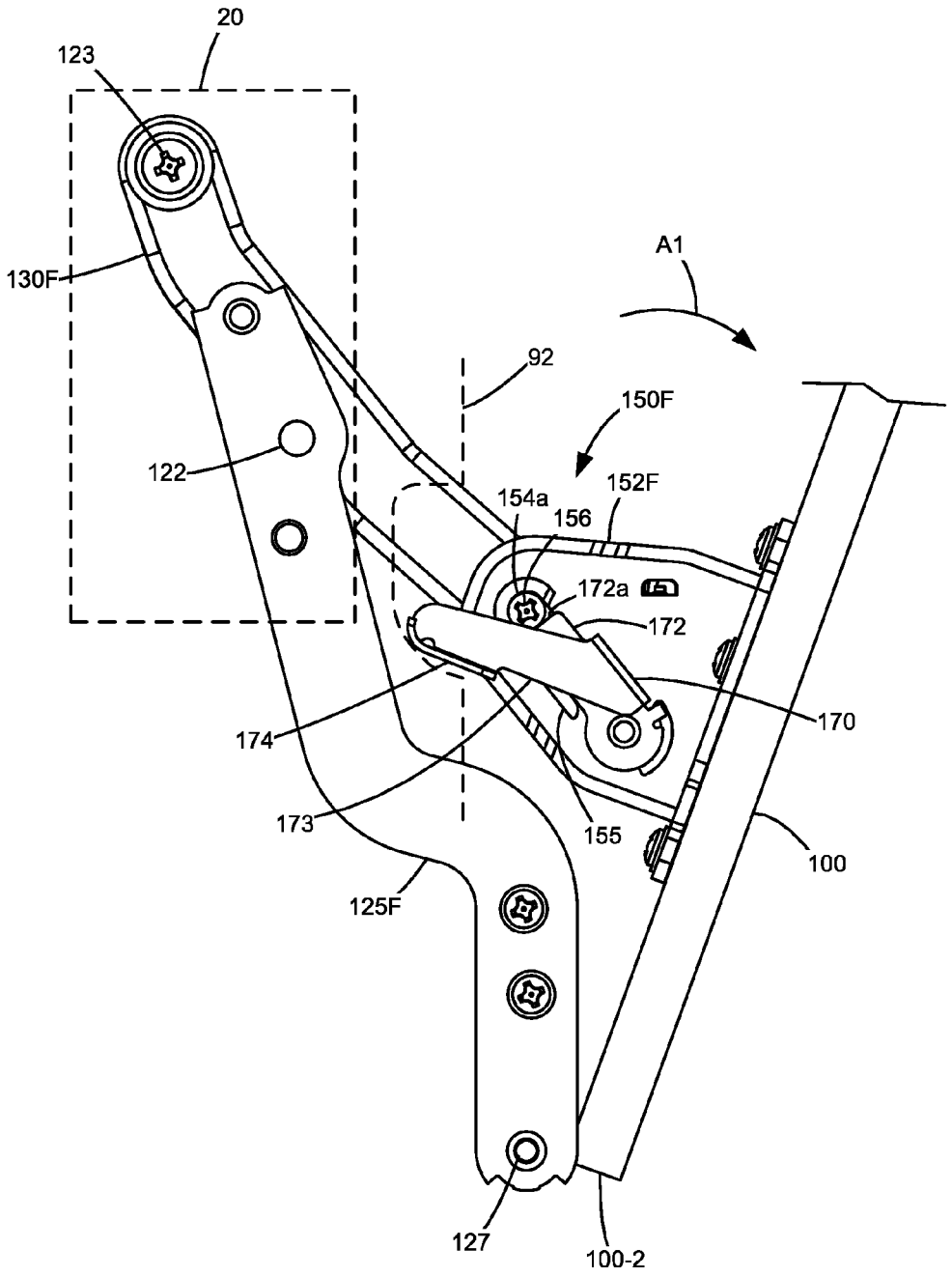
Figure 10A:
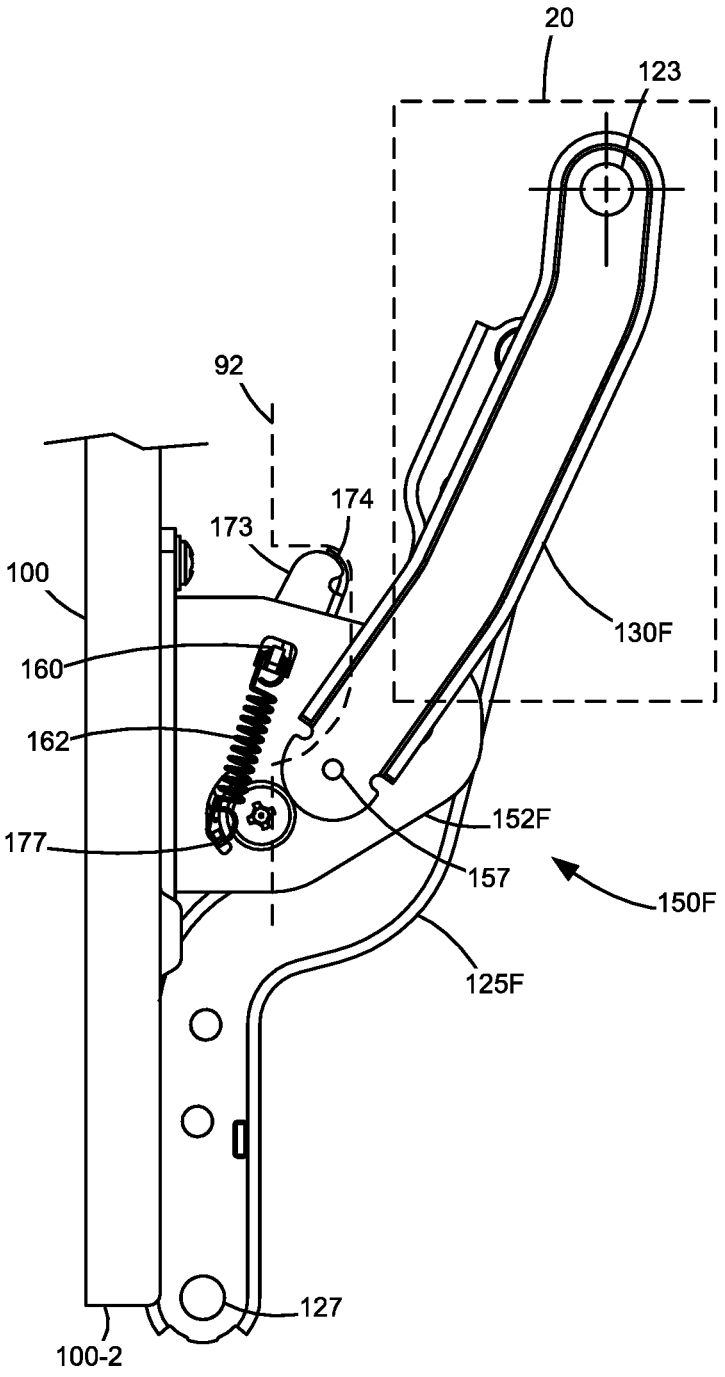
FIGS. 10A-10D are corresponding sequential rear views of FIGS. 9A-9D, respectively, when opening the side access door.

In FIGS. 9A and 10A, side access door 100 is in the raised closed position with lower link 125F shown in dashed lines in FIG. 9A. In the raised closed position, cam surface 174 of actuator arm 170 contacts guide surface 92 of housing 20 (both shown in dashed lines in FIGS. 9A, 9B, 10A and 10B for illustration purposes) causing actuator arm 170 to be rotated in the clockwise direction as viewed in FIG. 9A. Shoulder screw 156 is shown positioned at the second end portion 154*b* of elongated slot 154 and is translatable therealong since shoulder screw 156 is unobstructed by first arm portion 172 of actuator arm 170, resulting in compound joint 150F forming the prismatic joint.

Figure 10B:
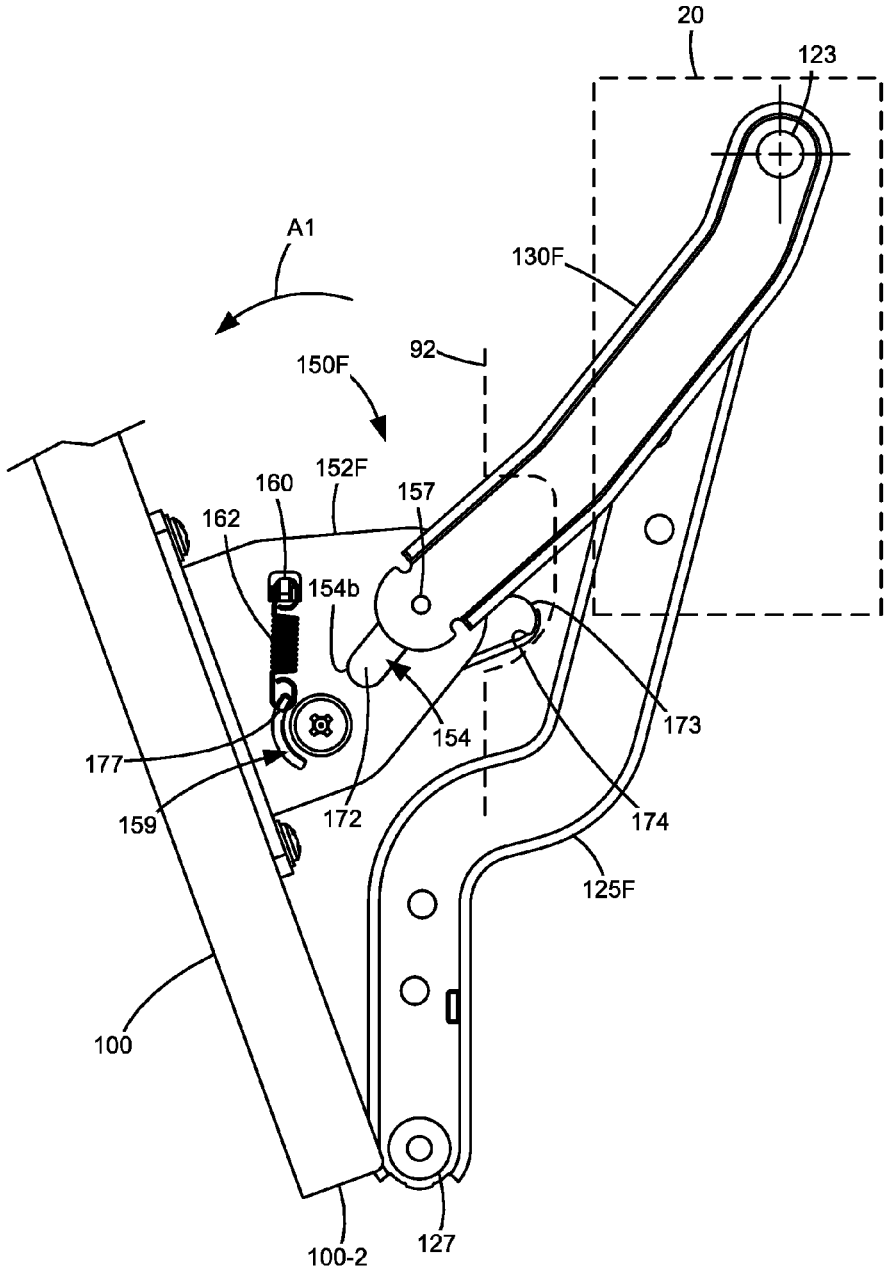

In FIGS. 9B and 10B, side access door 100 has been rotated from the raised closed position to the lowered open position, as indicated by arrow A1, about a pivot axis defined by first revolute joints 127 of lower links 125F, 125R. During unlatching motion in which side access door 100 is rotated from the raised closed position to the lowered open position about first revolute joints 127, shoulder screw 156 translates along the elongated slot 154 from the second end portion 154*b* to the first end portion 154*a* thereof as actuator arm 170 rotates counter-clockwise (as viewed in FIG. 9B) due to the biasing force of bias spring 162. Cam surface 174 of second arm portion 173 slides downward against guide surface 92 pivoting free end 172*a* of first arm portion 172 in a downward direction toward first end portion 154*a* of elongated slot 154. In an example embodiment, shoulder screw 156 arrives at the first end portion 154*a* of elongated slot 154 before or substantially about the same time first arm portion 172 of actuator arm 170 abuts ledge 155. Once side access door 100 reaches the lowered open position, first arm portion 172 of actuator arm 170 abuts and locks out linear movement of shoulder screw 156 along elongated slot 154, resulting in compound joint 150 transforming from the prismatic joint into the second revolute joint.

Figure 9C:
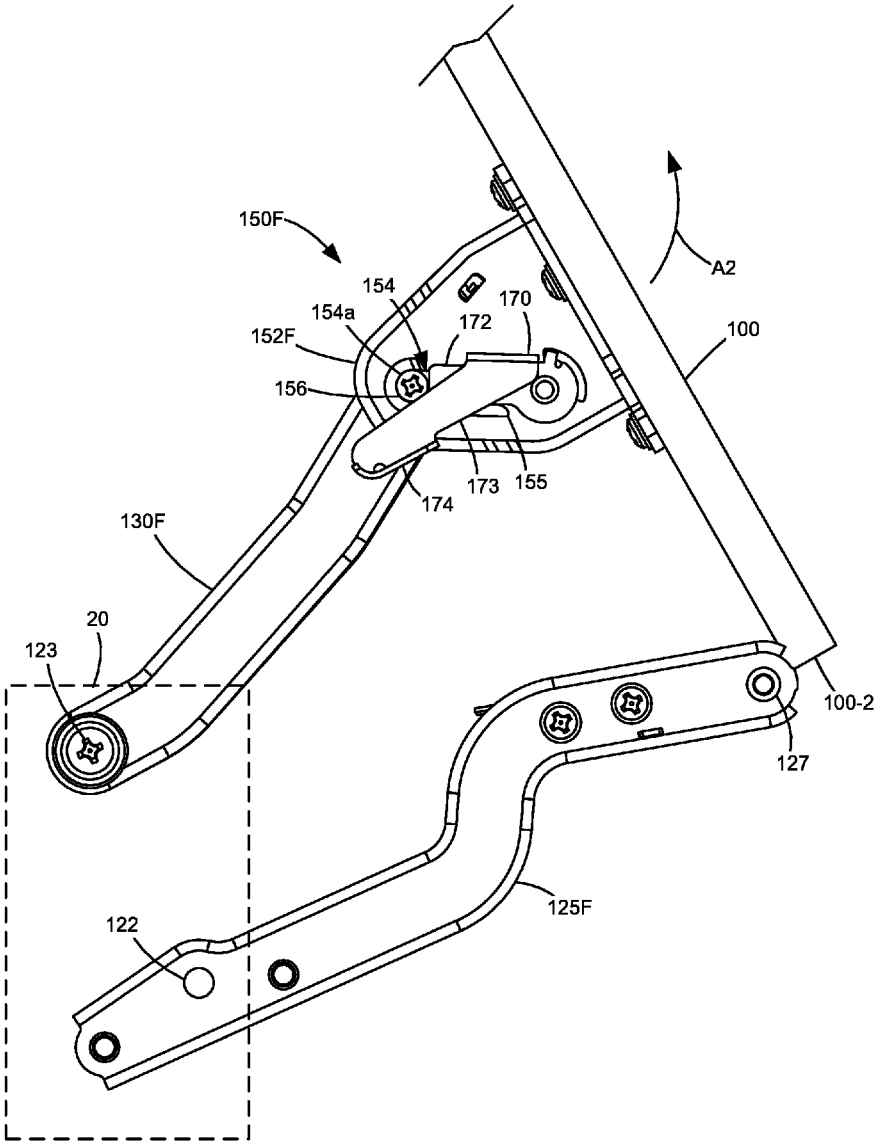
Figure 9D:
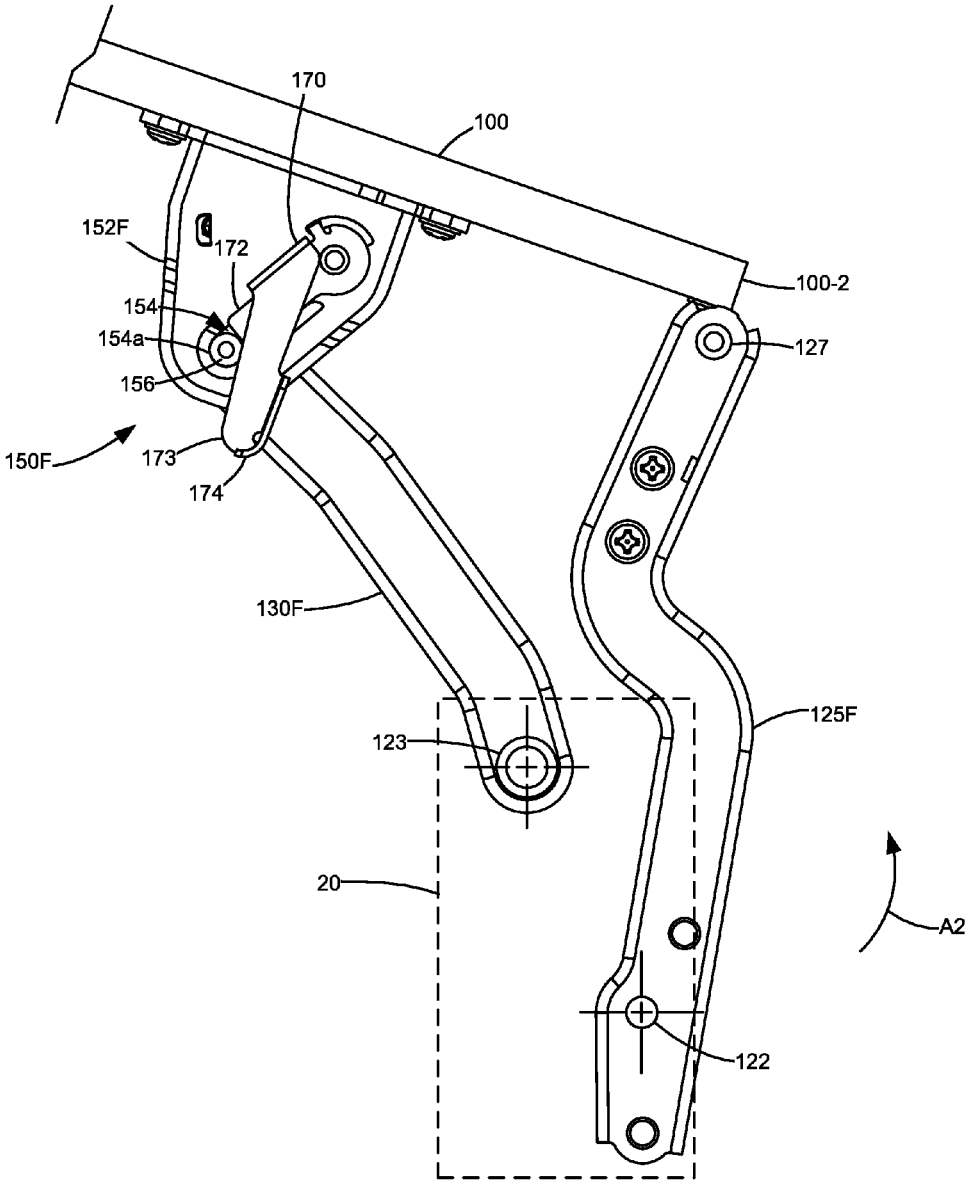
Figure 10C:
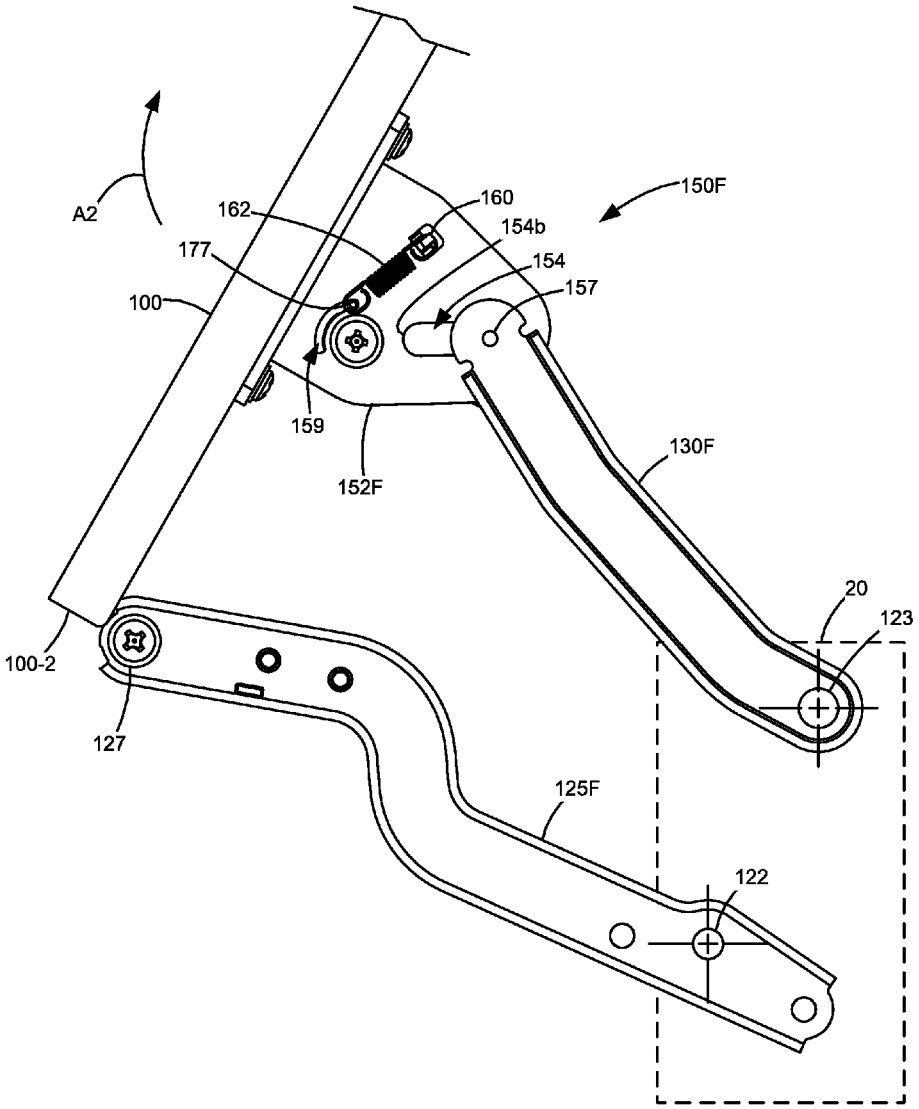
Figure 10D:
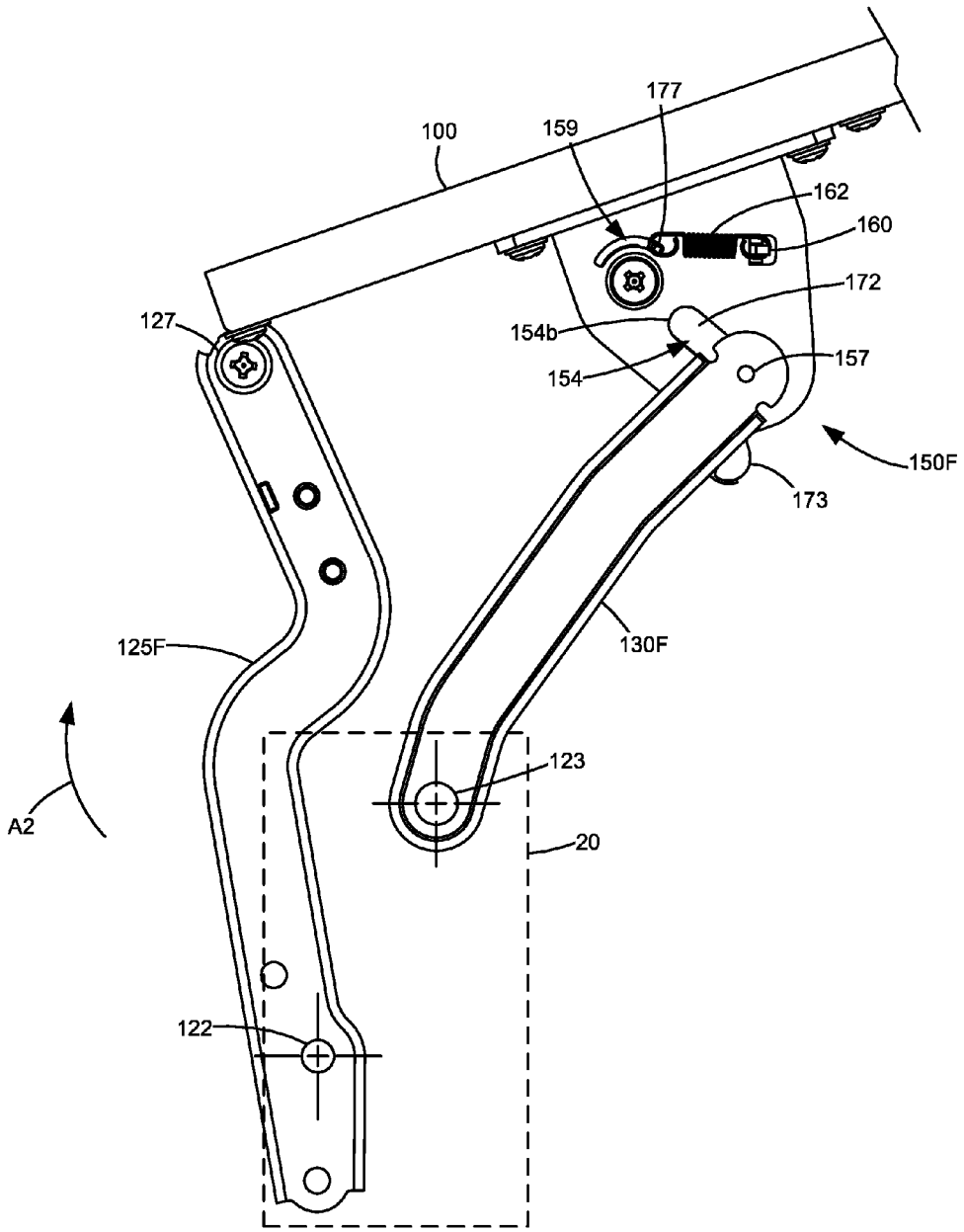

In FIGS. 9C and 10C, side access door 100 has begun to be lifted upward and rotated from the lowered open position, as indicated by arrow A2. Bias spring 162 continues to apply biasing force to actuator arm 170 such that compound joint 150 remains the second revolute joint with first arm portion 172 of actuator arm 170 locking shoulder screw 156 at the first end portion 154*a* of elongated slot 154. In FIGS. 9D and 10D, side access door 100 has been further rotated open to the raised open position with compound joint 150F still forming the second revolute joint. Accordingly, first arm portion 172 of actuator arm 170 remains seated at ledge 155 during the opening motion of side access door 100 such that first arm portion 172 prevents shoulder screw 156 from sliding in elongated slot 154 toward second end portion 154*b* and compound joint 150F continues to remain as the second revolute joint. In an example embodiment, lower link 125 rotates approximately 156° about pivot axis 122 with side access door 100 rotating about the first revolute joint 127 of lower link 125F at the first attachment point 106 and rotating about the second revolute joint (shoulder screw 156) of upper link 130F at the second attachment point 106 during opening motion of side access door 100 from the lowered open position to the raised open position.

Operation of compound joint 150F during closing motion and latching motion of side access door 100 is reversed relative to that described above. During the closing motion of side access door 100, compound joint 150F remains as the second revolute joint in which first arm portion 172 of actuator arm 170 continues to be seated on ledge 155 locking out linear motion of shoulder screw 156 along elongated slot 154 as side access door 100 is rotated and lowered from the raised open position (FIGS. 9D and 10D) to the lowered open position (FIGS. 9B and 10B). During the latching motion of side access door 100 in which side access door 100 is rotated about the first revolute joint 127 of lower link 125F from the lowered open position (FIGS. 9B and 10B) to the raised closed position (FIGS. 9A and 10A), cam surface 174 of second arm portion 173 of actuator arm 170 contacts guide surface 92 on housing 20. As side access door 100 continues to close, cam surface 174 on actuator arm 170 travels along and rides up guide surface 92, lifting actuator arm 170 and causing the first arm portion 172 thereof to rotate away from elongated slot 154. As side access door 100 is rotated further closed, cam surface 174 on actuator arm 170 continues to ride up guide surface 92 allowing shoulder screw 156 to translate along elongated slot 154 from the first end portion 154*a* to the second end portion 154*b* thereof until side access door 100 is fully closed in the raised closed position. Accordingly, compound joint 150F becomes the prismatic joint during the latching motion of side access door 100.

Figure 11:
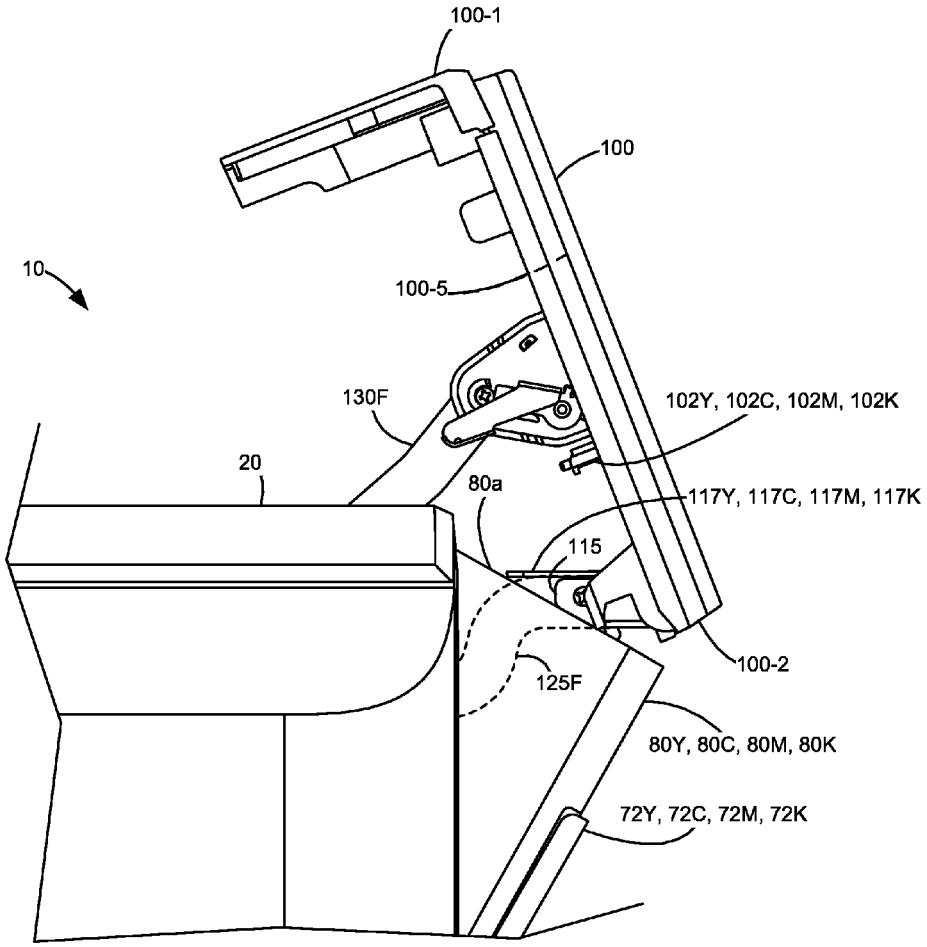
FIG. 11 illustrates a stop feature of the side access door preventing closure thereof when a toner cartridge is unlatched during closing motion of the side access door.
Figure 12:
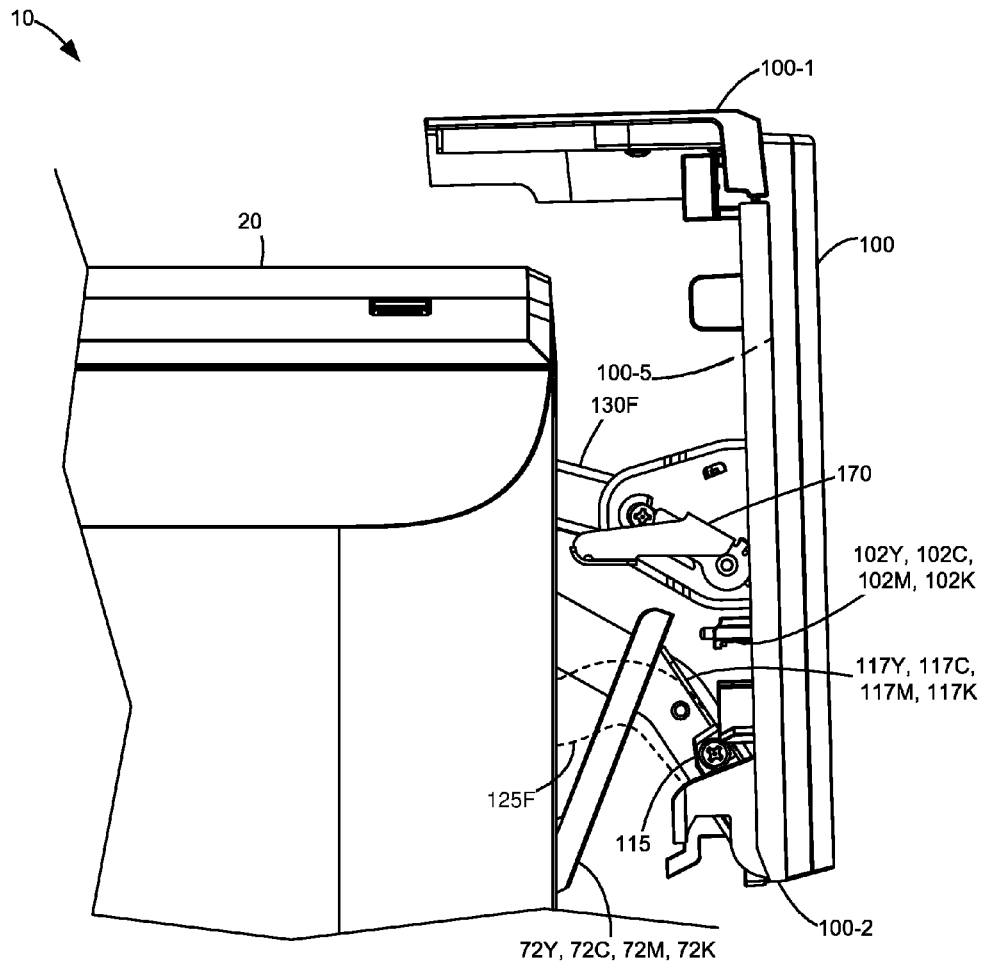
FIG. 12 illustrates the side access door having a plurality of flaps deflecting empty cradles into the imaging device when the side access door is closed.

In the example embodiment illustrated, door release handle 104 is provided near top 100-1 of side access door 100 and actuation fingers 102C, 102M, 102Y, 102K are disposed on the inner surface 100-5 of side access door 100 between top 100-1 and bottom 100-2 thereof closer to the first revolute joints 127 relative to the distance of door release handle 104 from first revolute joints 127 (see FIGS. 11-12). Accordingly, during the latching motion of side access door 100, actuation fingers 102C, 102M, 102Y, 102K engage and apply forces on respective plungers 82C, 82M, 82Y, 82K each at a distance that is closer to the pivot axis defined by first revolute joints 127 than a distance of a user-applied closing force CF (See FIG. 2) on door release handle 104 from the same pivot axis which allows for a mechanical advantage that reduces the amount of effort required from a user to push side access door 100 in the lowered open position toward opening 90 and latch side access door 100 in the raised closed position. In one embodiment, positioning of actuation fingers 102C, 102M, 102Y, 102K and door release handle 104 relative to the pivot axis defined by first revolute joints 127 is selected to provide a mechanical advantage that allows for a closing force CF that is in the range of 20 N to no more than 22.2 N, such as about 20.9 N, during latching motion of side access door 100.

Actuation fingers 102C, 102M, 102Y, 102K on side access door 100 engage respective plungers 82C, 82M, 82Y, 82K of toner cartridges 80C, 80M, 80Y, 80K when side access door 100 is closed while toner cartridges 80C, 80M, 80Y, 80K are on their respective installed operating positions, allowing proper operation of the shutter system between each toner cartridge and its respective mating developer unit. In order to ensure that each toner cartridge is latched to its operating position prior to closing side access door 100, a stop member 115 shown as a bar 115 (see FIGS. 5A and 5B) is connected between lower links 125F, 125R and is positioned to be obstructed by a top surface 80*a* of an unlatched toner cartridge 80, as shown in FIG. 11, while such toner cartridge 80 is in an unlatched position when side access door 100 is being closed. In this way, side access door 100 is prevented from closing when at least one toner cartridge 80 is in the unlatched position. In the example embodiment shown in FIGS. 5A and 5B, a plurality of flaps 117C, 117M, 117Y, 117K extend from bar 115 toward toner cartridges 80C, 80M, 80Y, 80K. Each flap 117C, 117M, 117Y, 117K may be made of a compliant or resilient material, such as plastic, and is arranged to deflect a corresponding cradle 72C, 72M, 72Y, 72K inwardly into opening 90 when side access door 100 is closed and no toner cartridge is installed in the corresponding cradle, as shown in FIG. 12. By having flaps 117C, 117M, 117Y, 117K, corresponding empty cradles 72C, 72M, 72Y, 72K are deflected away from actuation fingers 102C, 102M, 102Y, 102K providing a clearance gap to prevent the corresponding empty cradle from obstructing and damaging its actuation finger as side access door 100 is closed.

Figure 13:
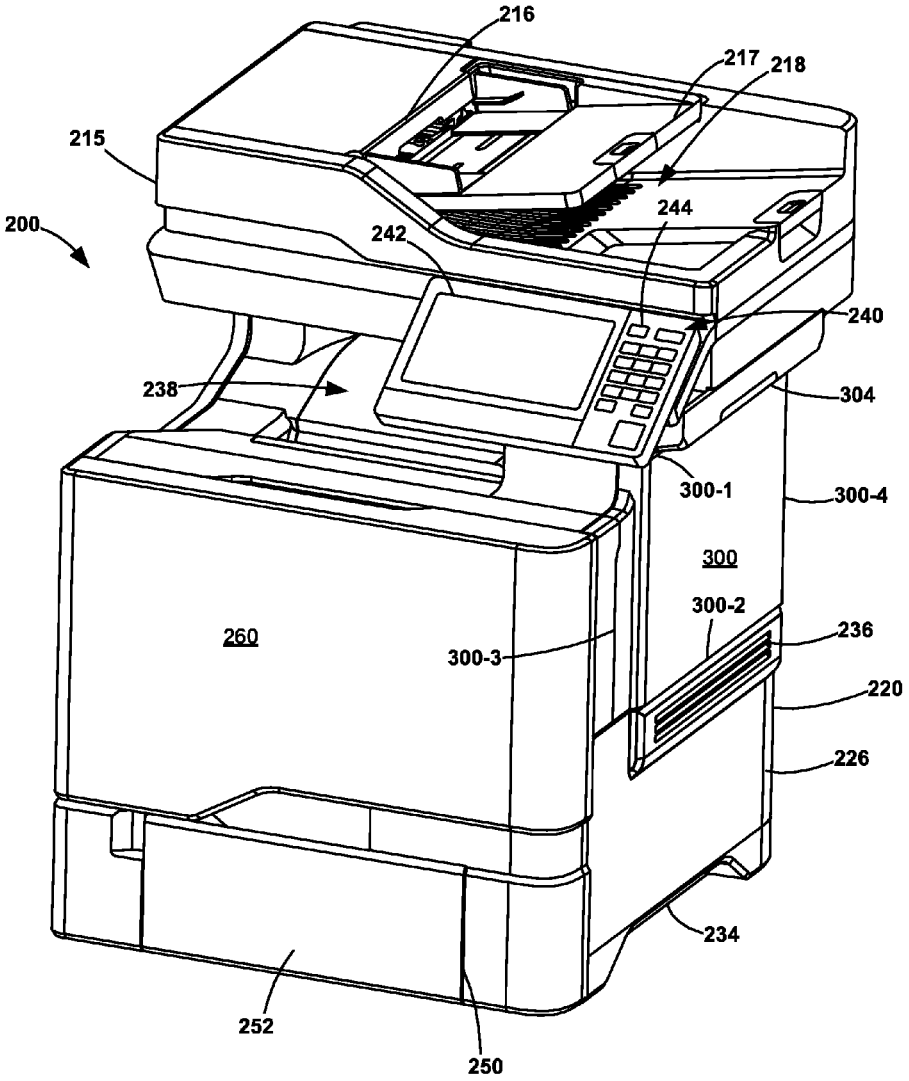
FIGS. 13-15 are illustrations of an imaging device having a scanner superstructure and with a side access door in a raised closed position, a lowered open position, and a raised open position, respectively, according to another example embodiment.
Figure 14:
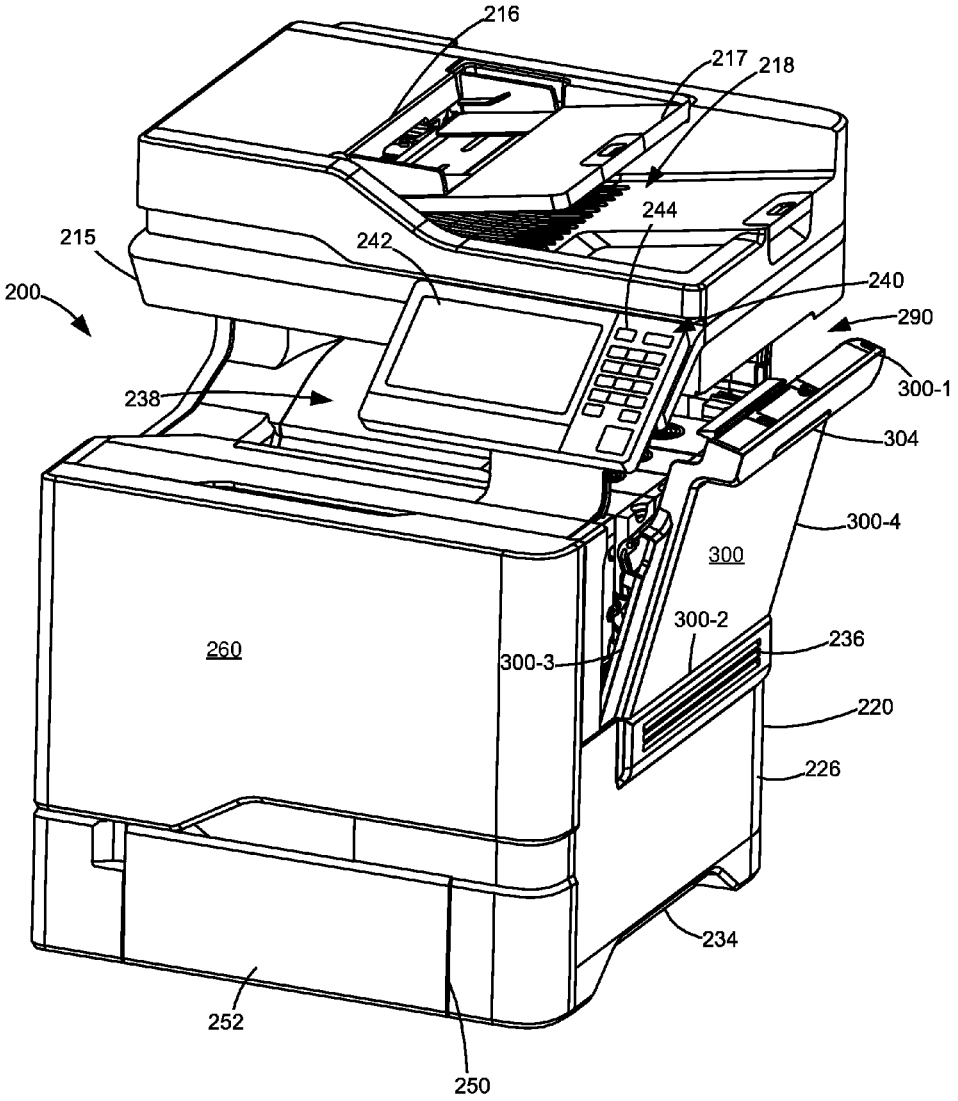
Figure 15:
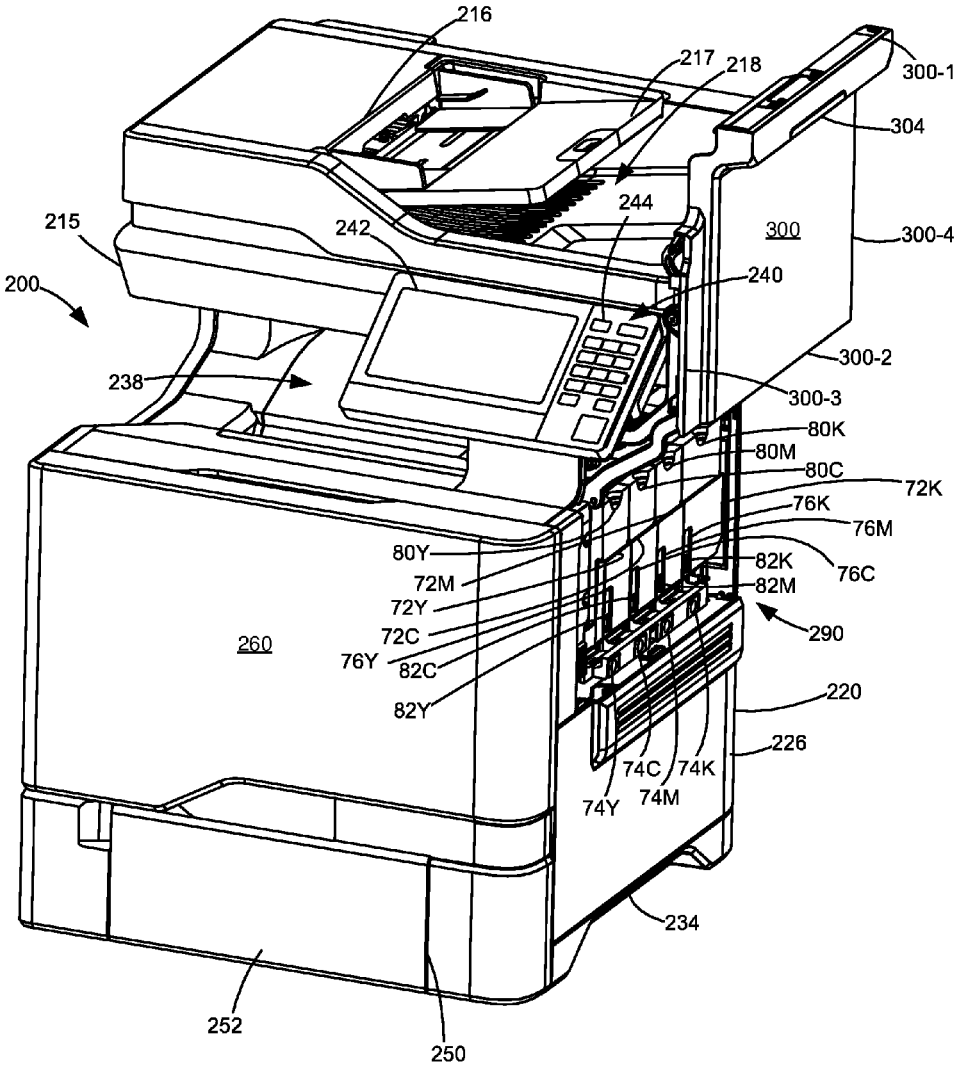

With reference to FIGS. 13-15, an imaging device 200 is shown with a scanner superstructure 215 disposed on top of imaging device 200, according to an example embodiment. Scanner superstructure 215 includes an automatic document feeder 216 having an input tray 217 and output area 218 for holding scanned media. Imaging device 200 may include similar features to that of imaging device 10, such as a removable media tray 250, multipurpose input tray 252, hand grips 234, vent 236, a front access door 260, and a side access door 300, among others. A user interface 240 comprising a display 242 and a key panel 244 is disposed above imaging device 10 on scanner superstructure 215. Mounting scanner superstructure 215 on top of imaging device 200 forms a caved media output area 238 for receiving printed media.

Side access door 300 has a top edge 300-1, a bottom edge 300-2, a left or front edge 300-3, and a right or rear edge 300-4. An access door release handle 304 is provided near top edge 300-1 and is used to open side access door 300 to allow user access into the interior of imaging device 200 via an opening 290. Side access door 100 is shown in a raised closed position in FIG. 13, in a lowered open position in FIG. 14, and in a raised open position in FIG. 15. In the raised closed position, side access door 100 substantially covers opening 290 and forms a portion of side 226 of housing 220. In the lowered open position, side access door 100 is pivoted open about a pivot axis adjacent its bottom edge 300-2 partially exposing an upper portion of opening 290. In the raised open position, side access door 300 is raised above opening 290 allowing full access to interior components disposed within opening 290. Because of the presence of scanner superstructure 215, side access door 100 is positioned on side 226 of imaging device 200 and/or substantially parallel thereto adjacently above opening 290 when in the raised open position.

Figure 16:
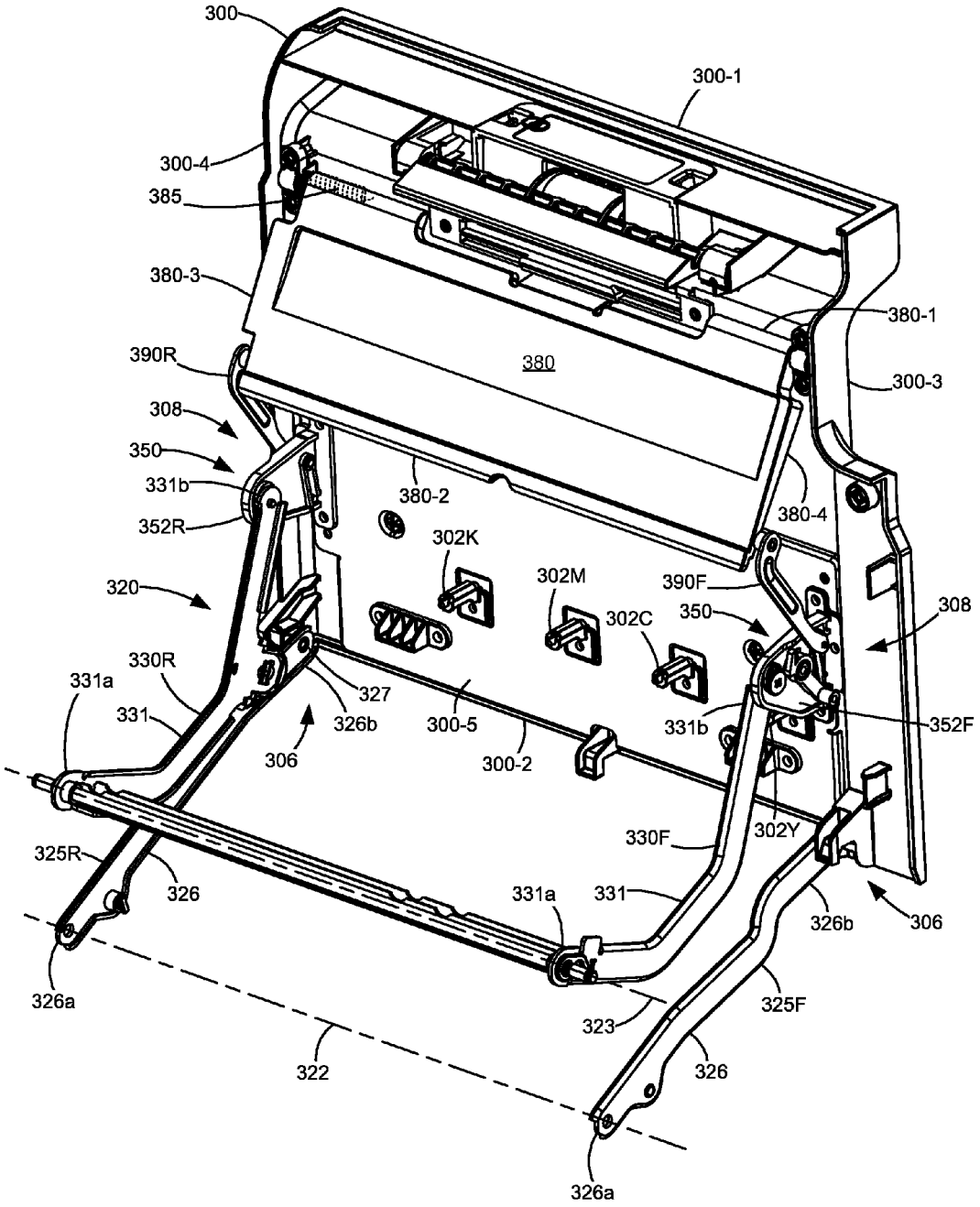
FIG. 16 is a perspective illustration of the side access door of FIGS. 13-15 with a linkage assembly having a second example embodiment of compound joint connections of the present disclosure.

With reference to FIGS. 15-16, side access door 300 includes a plurality of actuation fingers 302C, 302M, 302Y, 302K mounted on an inner surface 300-5 thereof for actuating respective plungers 82C, 82M, 82Y, 82K of toner cartridges 80C, 80M, 80Y, 80K (FIG. 15). When side access door 300 is in its raised closed position, actuation fingers 302C, 302M, 302Y, 302K are aligned with corresponding openings 76C, 76M, 76Y, 76K in cradles 72C, 72M, 72Y, 72K for passage therethrough to engage with corresponding plungers 82C, 82M, 82Y, 82K. Release buttons 74C, 74M, 74Y, 74K as previously described are provided for cradles 72C, 72M, 72Y, 72K, respectively.

A four-bar linkage assembly 320 according to an example embodiment is provided between housing 220 of imaging device 200 and side access door 300 that allows a user to provide less than 22.2 N of force to close side access door 300 from the lowered open position to the raised closed position. In the example embodiment illustrated, linkage assembly 320 is generally a four-bar mechanism including a pair of lower links 325F, 325R and a pair of upper links 330F, 330R connected between side access door 300 and housing 220.

Linkage assembly 320 of imaging device 200 allows for a two-step operation of side access door 300 when opening or closing side access door 300 relative to opening 290, similar to that of linkage assembly 120 of imaging device 10. Side access door 300 is unlatched by actuating door release handle 304 and rotating side access door 300 about a pivot axis adjacent its bottom edge 300-2 from the raised closed position (FIG. 13) to the lowered open position (FIG. 14). From the lowered open position, side access door 300 may be lifted upward until side access door 300 comes to rest parallel to the side 226 of imaging device 200 in the raised open position (FIG. 15). Conversely, from the raised open position, side access door 300 may be lowered until it reaches the lowered open position. Thereafter, side access door 300 may be rotated about the pivot axis adjacent its bottom edge 300-2 toward opening 290 until it is latched in the raised closed position.

As before, for ease of description, pivotal motion of side access door 300 between the raised closed position and lowered open position is referred to as latching motion (motion from the lowered open position to the raised closed position) or unlatching motion (motion from the raised closed position to the lowered open position) of side access door 300, while the lifting and lowering motion of side access door 300 between the lowered open position and raised open position are referred to as opening motion (motion from the lowered open position to the raised open position) and closing motion (motion from the raised open position to the lowered open position) of side access door 300.

Each of lower links 325F, 325R includes an arm portion 326 having a first end 326*a* pivotably attached to housing 220 about a pivot axis 322, and a second end 326*b* connected to side access door 300 using a first revolute joint 327 at a first attachment point 306 to allow rotational motion of side access door 300 relative to lower link 325 when moving side access door 300. Each of upper links 330F, 330R includes an arm portion 331 having a first end 331*a* pivotably attached to housing 220 about a pivot axis 323, and a second end 331*b* connected to side access door 300 using a compound joint 350 at a second attachment point 308 above the first attachment point 306 thereof. In an example embodiment, each compound joint 350 is transformable between a prismatic joint and a revolute joint as side access door 300 moves between the raised closed position, the lowered open position, and the raised open position. In particular, each compound joint 350 forms a prismatic joint as side access door 300 moves between the raised closed position and the lowered open position during latching or unlatching motion thereof, and forms a second revolute joint as side access door 300 moves between the lowered open position and the raised open position during opening or closing motion thereof. When side access door 300 moves between the raised closed position and the lowered open position, compound joint 350 as the prismatic joint allows translational motion of side access door 300 relative to upper links 330F, 330R at the respective second attachment points 308 as the bottom edge 300-2 of side access door 300 rotates about the pivot axis defined by the first revolute joints 327 at the respective first attachment points 306 thereof. When side access door 300 moves between the lowered open position and the raised open position, compound joint 350 as the second revolute joint allows rotational motion of side access door 300 relative to upper links 330F, 330R at the respective second attachment points 308 as side access door 300 rotates about the first revolute joints 327 of lower links 325F, 325R at the respective first attachment points 306.

Figure 17:
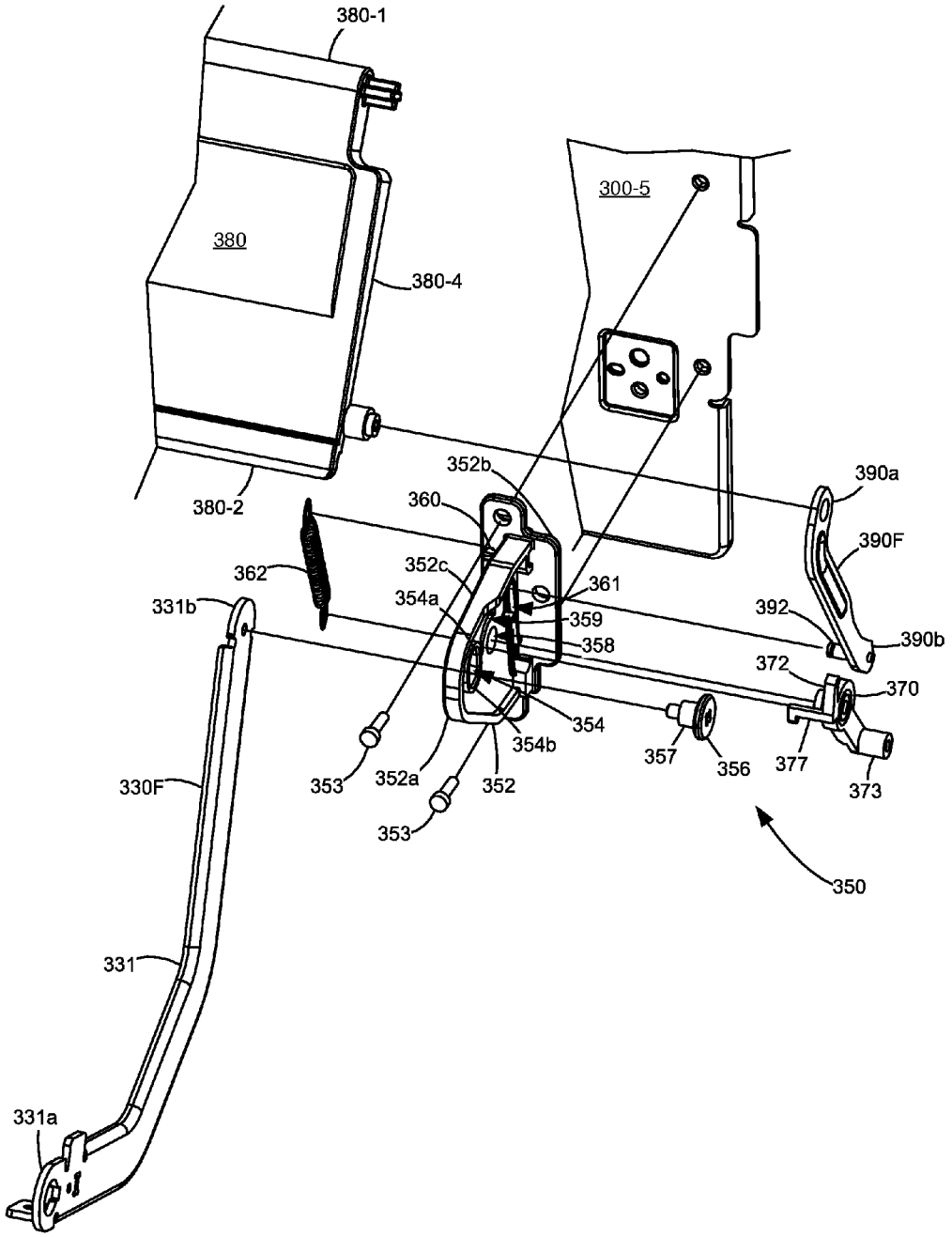
FIG. 17 is an exploded perspective view of the second example embodiment of a compound joint connection of FIG. 16.
Figure 18A:
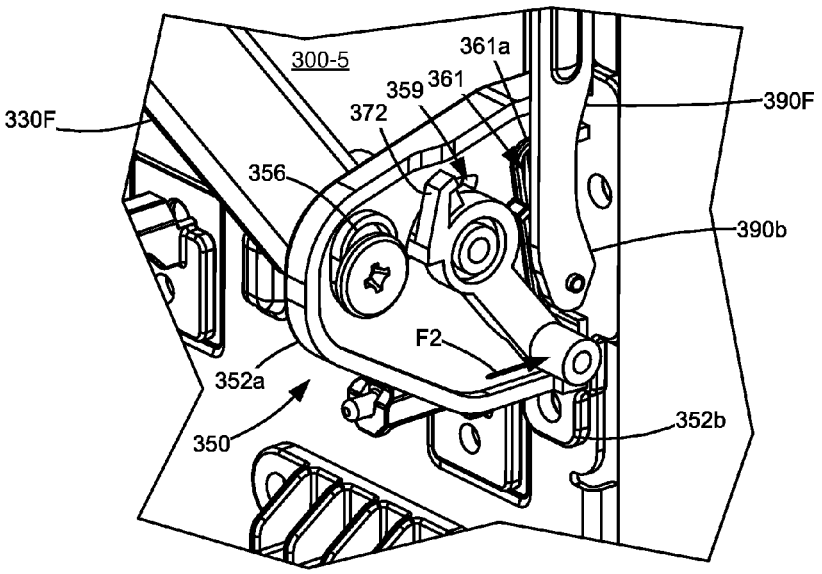
FIGS. 18A-18B are left and right side perspective illustrations of the second example embodiment of a compound joint connection of FIG. 16 when the side access door is in the raised closed position.
Figure 18B:
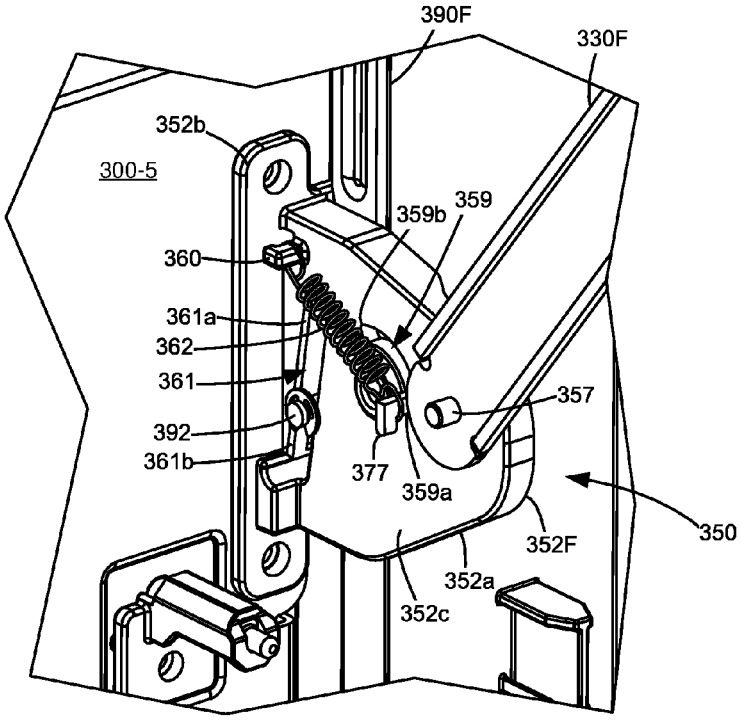

Details of compound joint 350 used in side access door 300 of imaging device 200 are illustrated in FIGS. 16-18B. Because both compound joints 350 are similar, only compound joint 350 connected to upper link 330F is shown in FIGS. 17-18B. As seen in FIG. 16, the inner surface 300-5 of side access door 300 is provided with a pair of aligned spaced apart mounts 352F, 352R at opposite sides 300-3, 300-4 of side access door 300. Hereinafter, any one of mounts 352F, 352R may be referred to as mount 352. Mount 352 comprises a base 352*b* having an arm 352*a* depending therefrom. Mounts 352F, 352R are secured to inner surface 300-5 of side access door 300 by fasteners 353 in substantially the same manner as mounts 152F, 152R. A slot 354 is formed on arm 352*a* of each mount 352 with each slot 354 having an upper end 354*a* and a lower end 354*b*. A shoulder screw 356 has a sliding member or slide pin 357 that passes through slot 354 and operatively couples with second end 331*b* of upper link 330 such that slide pin 357, together with the second end 331*b* of upper link 130, is movable along slot 354.

In the example embodiment illustrated, a spring-biased flap member 380 is provided on side access door 300 for preventing closure of side access door 300 when at least one toner cartridge 80 is unlatched during the closing motion of side access door 300. Flap member 380 has an upper end 380-1 pivotably mounted on side access door 300 and is continuously biased by a biasing member, such as for example torsion spring 385 (see FIG. 16), to fold out in a direction towards opening 290 away from inner surface 300-5 of side access door 300. Link arms 390F, 390R are connected between mounts 352F, 352R and opposite sides 380-3, 380-4 of flap member 380 adjacent a lower end 380-2 thereof. An upper end 390*a* of each link arm 390F, 390R is pivotably attached to a respective side 380-3, 380-4 of flap member 380. A lower end 390*b* of each link arm 390F, 390R includes a slide pin 392 that passes through an elongate slot 361 formed on mount 352 for operatively coupling link arm 390F to mount 352 such that slide pin 392 travels along elongate slot 361 when flap member 380 is folded in or out relative to the inner surface 300-5 of side access door 300. A motion inhibitor arm 370 is pivotally attached to mount 352 via an opening 358 formed on mount 352 and is used to maintain the folded out position of flap member 380 during closing motion of side access door 300. Motion inhibitor arm 370 includes a latch head 372 and a protruding boss 373 at opposite ends relative to a center portion thereof. A spring post 360 is provided on an inner side 352*c* of mount 352 and a hook arm 377 extends from latch head 372 of motion inhibitor arm 370 through a curved guide slot 359 formed on mount 352. Motion inhibitor arm 370 is biased to rotate clockwise, as viewed in FIG. 18A, by a tension spring 362 connected between spring post 360 and hook arm 377.

Protruding boss 373 of motion inhibitor arm 370 is engageable by lower link 325 during latching and unlatching motion of side access door 300. In FIGS. 18A and 18B, hook arm 377 is shown positioned at a first end portion 359*a* of curved guide slot 359 with latch head 372 rotated away from an upper end portion 361*a* of elongate slot 361 when lower link 325 engages and applies a force F2 to protruding boss 373 against the biasing force of tension spring 362, such as when side access door 300 is in the raised closed position. When latch head 372 of motion inhibitor arm 370 is rotated away from elongate slot 361, slide pin 392 of link arm 390F is free to move along elongate slot 361 allowing flap member 380 to be folded in towards the inner surface 300-5 side access door 100. In FIG. 19C, latch head 372 is shown positioned at a second end portion 359*b* of curved guide slot 359 with actuator arm 170 rotated by tension spring 362 in the clockwise direction such that latch head 372 is rotated towards the upper end portion 361*a* of elongate slot 361 to prevent slide pin 392 from translating down elongate slot 361 and maintain the folded out position of flap member 380.

Figure 19A:
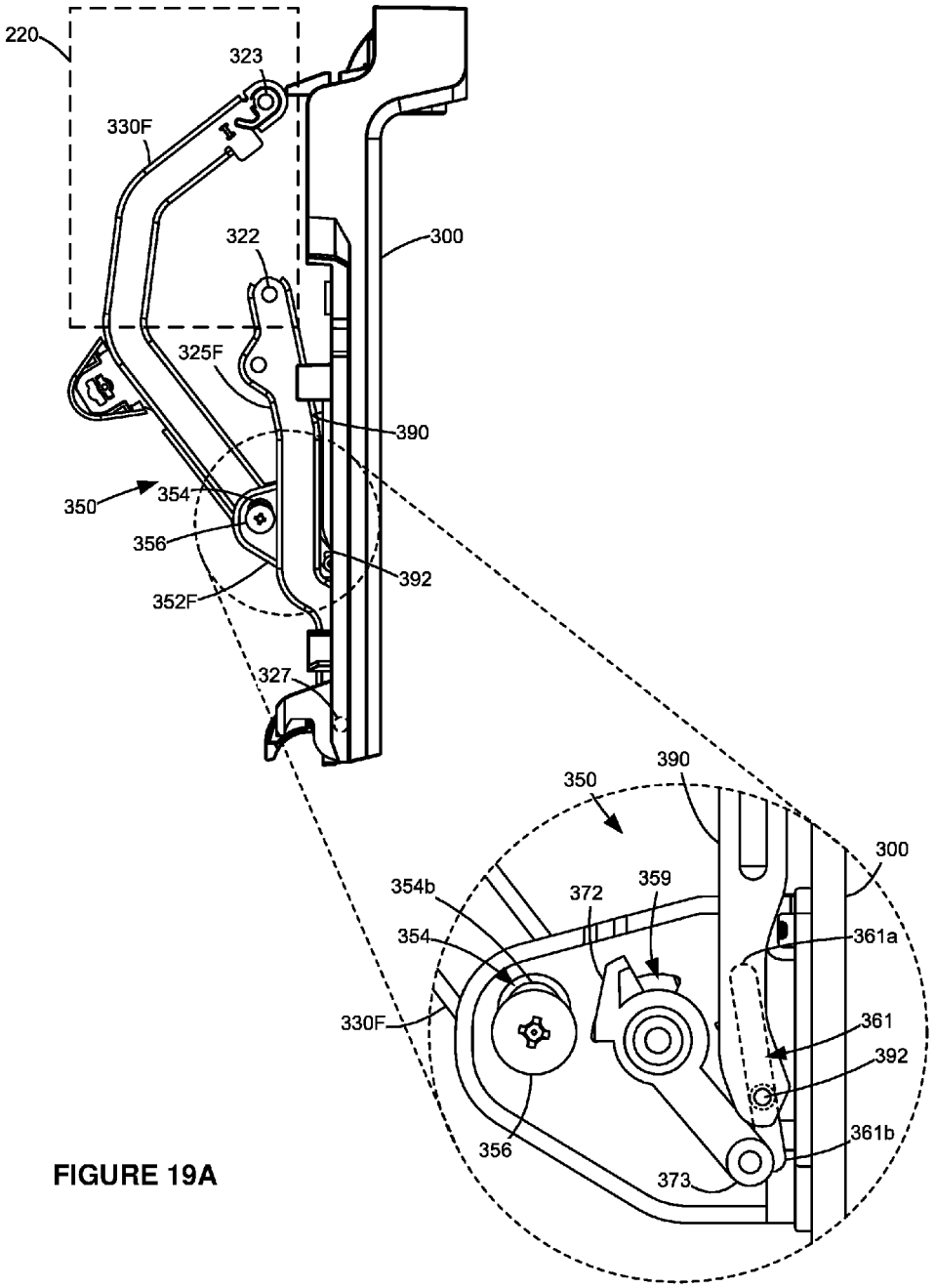
FIGS. 19A-19C are sequential front views illustrating the operation of the linkage assembly and the second example embodiment of a compound joint connection of FIG. 16 when opening the side access door of FIG. 16.
Figure 19B:
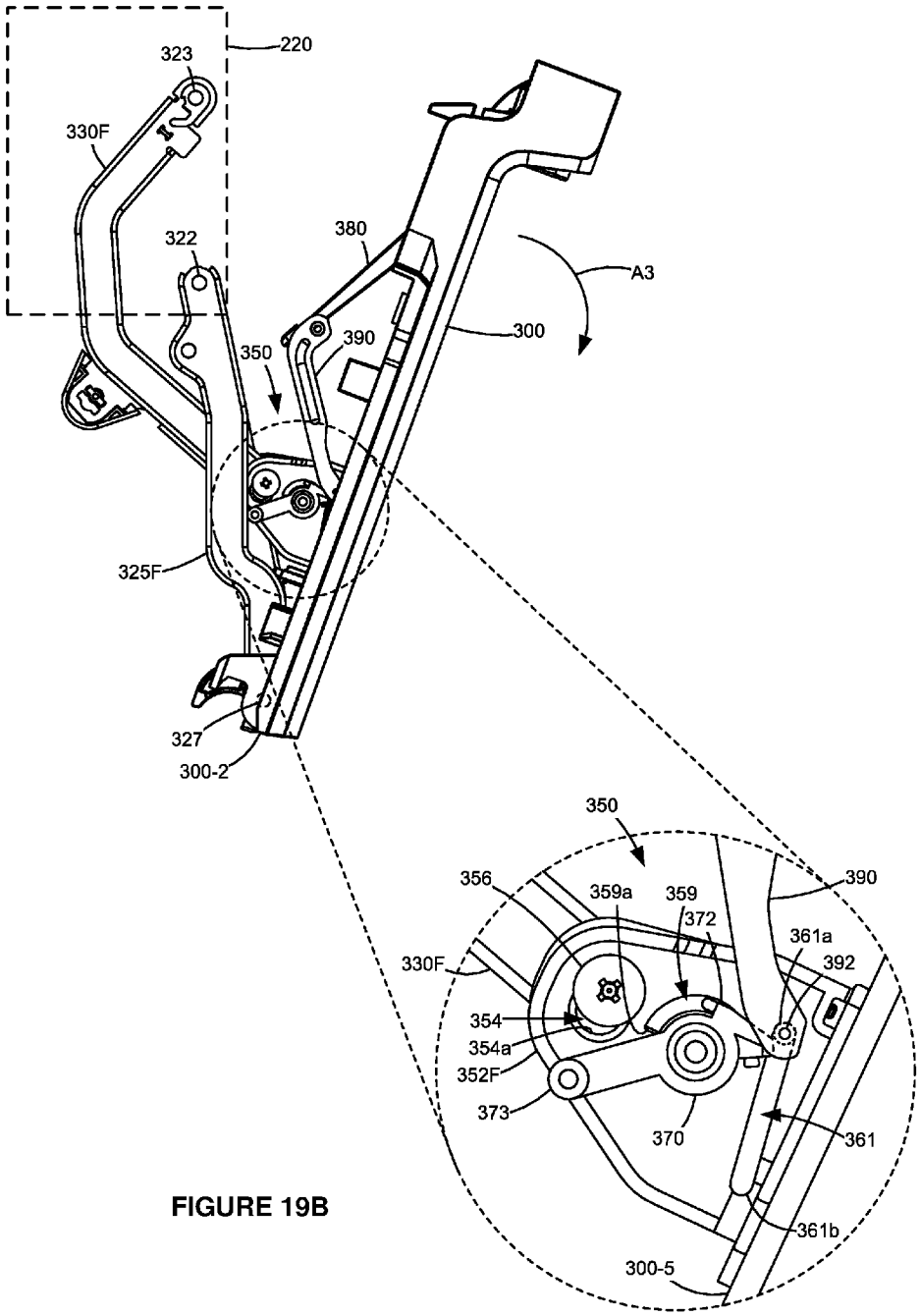
Figure 19C:
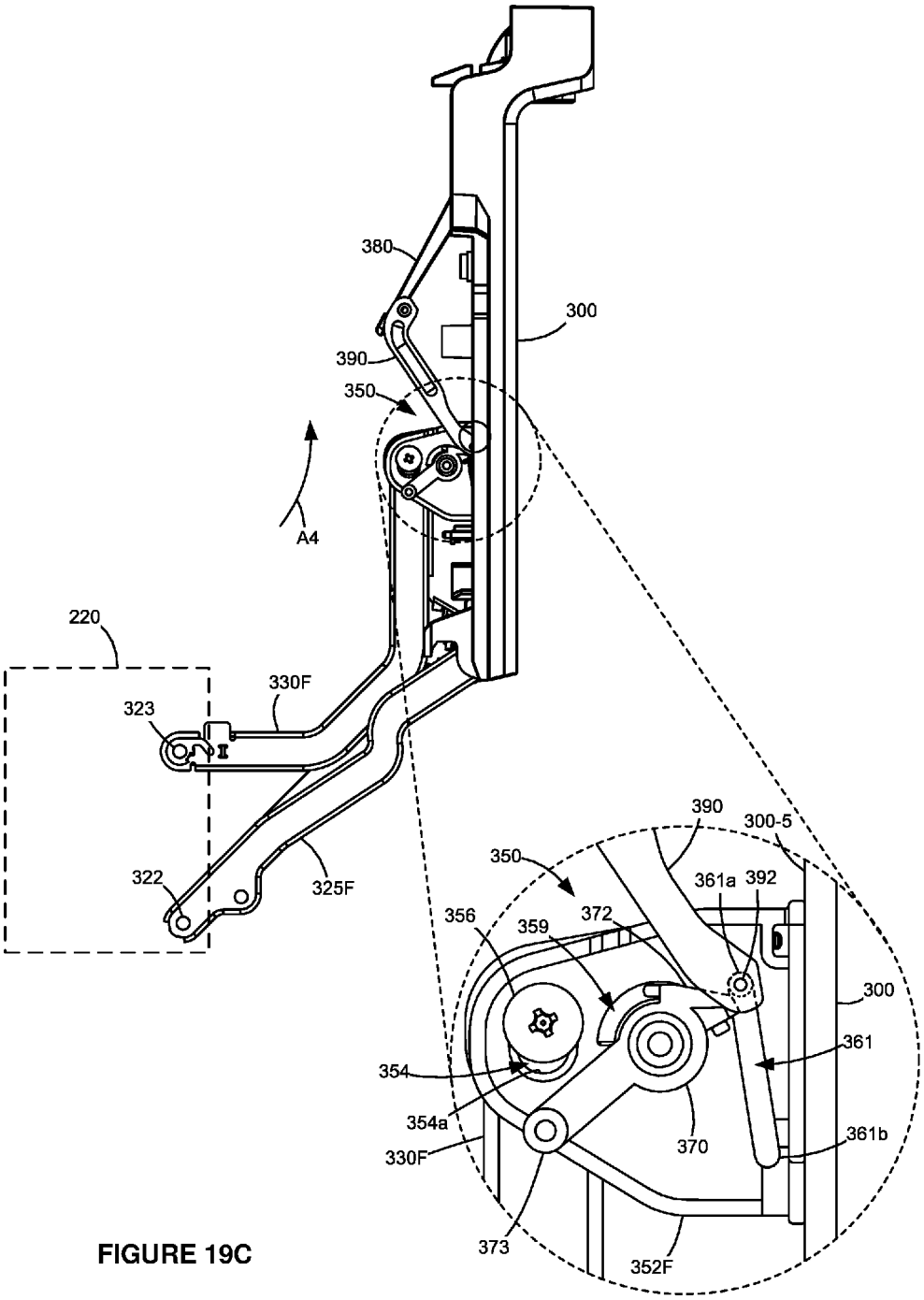

With reference to FIGS. 19A-19C, operation of side access door 300 of imaging device 200 will be described. Because features on both sides of side access door 300 operate in the same manner, only the features on one side are shown in FIGS. 19A-19C.

In FIG. 19A, side access door 300 is in the raised closed position with shoulder screw 356 positioned at the upper end 354*a* of slot 354 and translatable therealong resulting in compound joint 350 forming the prismatic joint. Lower link 325F pushes protruding boss 373 of motion inhibitor arm 370 towards the inner surface 300-5 of side access door 300 against the biasing force of tension spring 362 causing latch head 372 to be rotated in the counter-clockwise direction, as viewed in FIG. 19A, away from the upper end portion 361*a* of elongate slot 361. Slide pin 392 of link arm 390 is shown positioned closer to the second end portion 361*b* of elongate slot 361 as flap member 380 (hidden from view in FIG. 19A) is folded in toward the inner surface 300-5 of side access door 300. Slide pin 392 is translatable along elongate slot 361 since it is unobstructed by latch head 372 of motion inhibitor arm 370.

In FIG. 19B, side access door 300 has been rotated from the raised closed position to the lowered open position, as indicated by arrow A3, about a pivot axis defined by first revolute joints 327 of lower links 325F, 325R adjacent bottom edge 300-4 of side access door 300. During unlatching motion in which side access door 300 is rotated from the raised closed position to the lowered open position, compound joint 350 as the prismatic joint allows shoulder screw 356 to translate along slot 354 from the lower end 354*b* to the upper end 354*a* thereof. At the same time, when side access door 300 pivots away from opening 290 during the unlatching motion, the biasing force of tension spring 362 causes motion inhibitor arm 370 to rotate clockwise, as viewed in FIG. 19B, with lower link 325F limiting the amount of rotation as protruding boss 373 remains in contact with lower link 325F. As motion inhibitor arm 370 further rotates clockwise, latch head 372 is brought closer to the upper end section 361*a* of elongate slot 361 by tension spring 362. As flap member 380 is released from contact with interior components in opening 290, such as toner cartridges 80, flap member 380 is biased by torsion spring 385 toward its folded out position causing slide pin 392 of link arm 390 to ride up elongate slot 361 toward the upper end portion 361*a* thereof. In an example embodiment, slide pin 392 arrives at the upper end portion 361*a* of elongate slot 361 before or substantially about the same time latch head 372 of motion inhibitor arm 370 reaches the upper end portion 361*a* of elongate slot 361. Once side access door 300 reaches the lowered open position, latch head 372 of motion inhibitor arm 370 locks out downward movement of slide pin 392 along elongate slot 361 preventing flap member 380 from being folded in towards the inner surface 300-5 of side access door 100.

In FIG. 19C, side access door 300 has been lifted upward and rotated from the lowered open position to the raised open position, as indicated by arrow A4. During the opening motion of side access door 300, compound joint 350 remains the second revolute joint with shoulder screw 356 maintaining its position at the upper end 354*a* of slot 354 throughout the opening motion. In one example, side access door 300 may be spring balanced to rise through a majority of the opening motion so as to assist in maintaining shoulder screw 356 at the upper end 354*a* of slot 354. The biasing force of tension spring 362 holds latch head 372 at the upper end portion 361*a* of elongate slot 361 thereby keeping slide pin 392 at the upper end portion 361*a* of elongate slot 361 and maintaining flap member 380 in its folded out position during the opening motion of side access door 300.

Operation of compound joint 350 and flap member 380 during closing motion and latching motion of side access door 300 are reversed relative to that described above. During the closing motion of side access door 300, compound joint 350 remains as the second revolute joint in which shoulder screw 356 remains positioned at the upper end 354*a* of slot 354. Slide pin 392 of link arm 390 continues to be positioned at the upper end section 361*a* of elongate slot 361 with latch head 372 locking out downward motion of slide pin 392 along elongate slot 361 as side access door 300 is rotated and lowered from the raised open position (FIG. 19C) to the lowered open position (FIG. 19B). During the latching motion of side access door 100 in which side access door 100 is rotated about the pivot axis defined by first revolute joints 327 of lower link 325 from the lowered open position (FIG. 19C) to the raised closed position (FIG. 19A), shoulder screw 356 moves from the upper end 354*a* of slot 354 to the lower end 354*b* thereof. Accordingly, compound joint 350 becomes the prismatic joint during the latching motion of side access door 300. In addition, as side access door 300 is closed during latching motion, lower link 325F engages protruding boss 373 causing motion inhibitor arm 370 to rotate counter-clockwise, as viewed in FIG. 19A, against the biasing force of tension spring 362 and rotating latch head 372 away from the upper end section 361*a* of elongate slot 361 thereby unobstructing slide pin 392 of link arm 390. Upon flap member 380 contacting interior components in opening 290, such as toner cartridges 80, during the latching motion, the interior components pushes flap member 380 to fold in towards the inner surface 300-5 of side access door 300 causing slide pin 392 of link arm 390 to ride down elongate slot 361 toward the lower end section 361*b* thereof.

Figure 20:
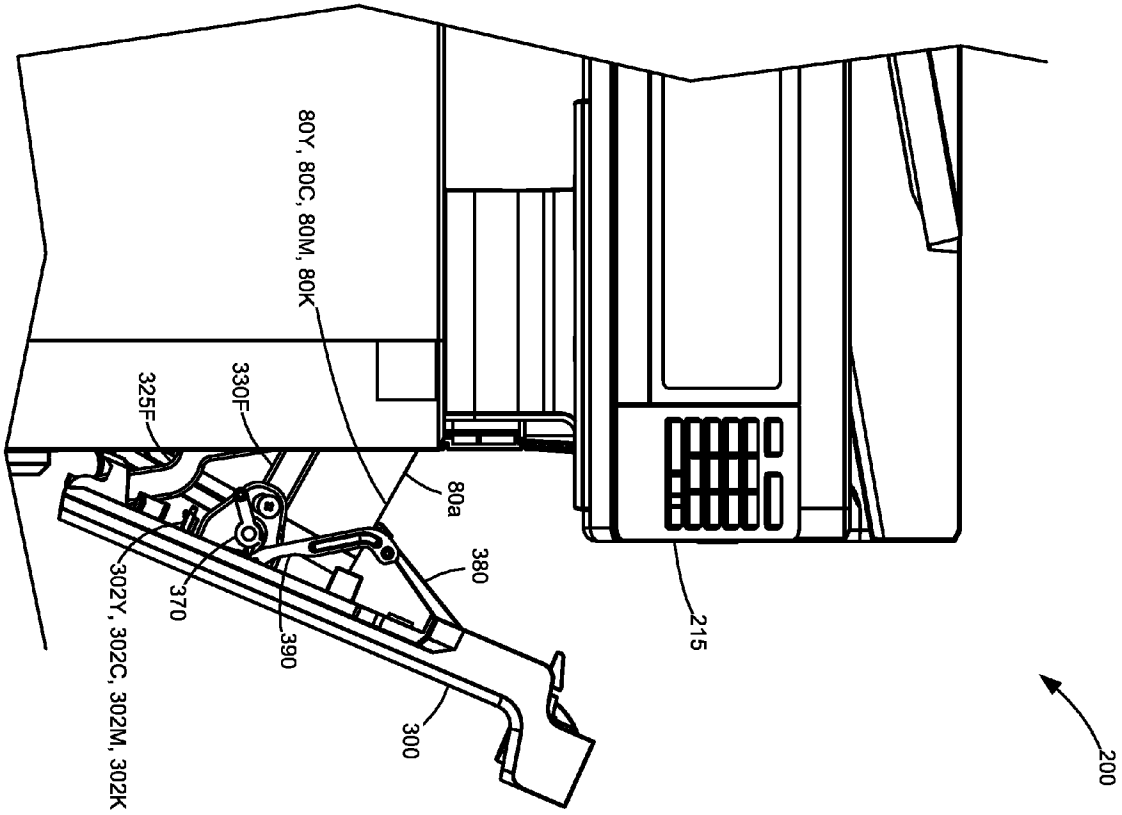
FIG. 20 illustrates a flap member of the side access door of FIG. 16 preventing closure thereof when a toner cartridge is unlatched during closing motion of the side access door.

Actuation fingers 302C, 302M, 302Y, 302K on side access door 300 engage respective plungers 82C, 82M, 82Y, 82K on toner cartridges 80C, 80M, 80Y, 80K when side access door 300 is closed while these toner cartridges are on their respective installed operating positions, allowing proper operation of the shutter system between toner cartridges 80C, 80M, 80Y, 80K and their respective mating developer units. When at least one of toner cartridges 80C, 80M, 80Y, 80K is unlatched to its operating position during the closing motion of side access door 100 as shown in FIG. 20, flap member 380 is obstructed by a top surface 80*a* of such unlatched toner cartridge preventing closure of side access door 300. When side access door 300 is closed and one of the cradles 72C, 72M, 72Y, 72 K is empty during latching motion, the inner surface 300-5 of side access door 300 contacts and deflects such empty cradle or cradles inwardly into opening 290.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments. It is intended that the scope of the present disclosure be defined by the claims appended hereto.

What is claimed is:

1. An access door assembly of an imaging device, comprising:

an access door movably mounted on a side of a housing of the imaging device, the access door movable between a raised closed position and a lowered open position and between the lowered open position and a raised open position, the access door substantially covering an opening on the side of the housing when in the raised closed position, is pivoted open about a pivot axis adjacent to a bottom edge thereof partially exposing an upper portion of the opening when in the lowered open position, and is raised above the opening when in the raised open position; and, a linkage assembly connected between the access door and the housing, the linkage assembly including:

a lower link connected to the access door using a first revolute joint at a first attachment point; and, an upper link connected to the access door using a compound joint at a second attachment point above the first attachment point, the compound joint transformable between a prismatic joint and a second revolute joint, with the compound joint forming the prismatic joint as the access door moves from the raised closed position to the lowered open position and forming the second revolute joint as the access door moves from the lowered open position to the raised open position;

wherein:

when the access door moves between the raised closed position and the lowered open position, the compound joint as the prismatic joint allows translational motion of the access door relative to the upper link at the second attachment point as the bottom edge of the access door rotates about the pivot axis defined by the first revolute joint at the first attachment point; and when the access door moves between the lowered open position and the raised open position, the compound joint as the second revolute joint allows rotational motion of the access door relative to the upper link at the second attachment point as the access door rotates about the first revolute joint at the first attachment point of the lower link.

2. The access door assembly of claim 1, further comprising a mount attached adjacent to a side of the access door and having a slot formed in a body thereof, and a slide pin coupled to an end of the upper link and passing through the slot, wherein the slide pin is translatable along the slot when the compound joint forms the prismatic joint to allow translational motion of the mount and the access door relative to the upper link as the access door moves between the raised closed position and the lowered open position.

3. The access door assembly of claim 2, further comprising an actuator arm pivotally attached to the mount and having a first arm portion, the actuator arm rotatable between a first position in which the first arm portion is rotated towards a first end portion of the slot and a second position in which the first arm portion is rotated away from the slot, wherein when the compound joint forms the second revolute joint, the slide pin is positioned at the first end portion of the slot and the actuator arm is in the first position such that the first arm portion holds the slide pin at the first end portion of the slot to allow the access door to rotate about the slide pin without the slide pin traveling along the slot as the access door moves between the lowered open position and the raised open position.

4. The access door assembly of claim 3, wherein when the compound joint forms the prismatic joint, the actuator arm is in the second position such that the slide pin is unobstructed by the first arm portion of the actuator arm and translatable along the slot.

5. The access door assembly of claim 3, further comprising a biasing member coupled between the actuator arm and the mount for biasing the actuator arm to the first position.

6. The access door assembly of claim 3, further comprising a ledge projecting from the mount along at least a portion of a perimeter of the slot, wherein when the compound joint forms the second revolute joint, the first arm portion of the actuator arm is biased against the ledge holding the actuator arm in the first position.

7. The access door assembly of claim 3, wherein the actuator arm has a second end opposite the first end thereof, the second end having a cam surface that is positioned to engage a guide surface of the housing when the access door moves from the lowered open position to the raised closed position so as to rotate the actuator arm towards the second position and allow the compound joint to form the prismatic joint.

8. The access door assembly of claim 1, further comprising a handle disposed adjacent to an upper edge of the access door, wherein with the access door in the lowered open position and the compound joint forming the prismatic joint, a user-supplied actuation force less than or equal to 22.2 N applied to the handle pivots the access door toward the raised closed position.

9. An access door assembly mounting to a housing of an imaging device for enclosing and seating one or more customer replaceable units therein, the access door assembly comprising:

an access door movably mounted relative to the housing, the access door movable between a raised closed position in which the access door covers an opening on a side of the housing, a lowered open position in which the access door is pivoted open about a pivot axis adjacent to a bottom edge thereof partially exposing the opening, and a raised open position in which the access door is raised above the opening permitting access to the one or more customer replaceable units via the opening; and, a four-bar linkage connected between the access door and the housing, the four-bar linkage including:

a pair of lower links with each lower link connected between the access door and the housing at a respective one of opposite sides of the access door, each lower link having a first revolute joint connection with the housing at a first end thereof and a second revolute joint connection with the access door at a second end thereof; and, a pair of upper links with each upper link connected between the access door and the housing at a respective one of the opposite sides of the access door, each upper link having a third revolute joint connection with the housing at a first end thereof and a compound joint connection with the access door at a second end thereof, the compound joint connection transformable between a prismatic joint connection and a fourth revolute joint connection as the access door moves between the raised closed position, the lowered open position, and the raised open position;

wherein:

when the access door moves between the raised closed position and the lowered open position, the second revolute joint connections at the respective second ends of the pair of lower links define the pivot axis about which the access door pivots, and the compound joint connections at the respective second ends of the pair of upper links form the prismatic joint connections which allow translational motion of the access door relative to the pair of upper links as the access door pivots about the second revolute joint connections; and when the access door moves between the lowered open position and the raised open position, the access door rotates about the second revolute joint connections at the respective second ends of the pair of lower links and the compound joint connections at the respective second ends of the pair of upper links form the fourth revolute joint connections which allow rotational motion of the access door relative to the pair of upper links as the access door rotates about the second revolute joint connections.

10. The access door assembly of claim 9, further comprising a pair of mounts respectively attached adjacent to the opposite sides of the access door with each mount having a slot formed in a body thereof, each compound joint connection including:

a sliding member coupled to the second end of a corresponding upper link and passing through and slidable along the slot; and, a locking mechanism attached to the mount for locking out linear motion of the sliding member along the slot to form the fourth revolute joint connection and unblocking the linear motion of sliding member along the slot to form the prismatic joint connection.

11. The access door assembly of claim 10, wherein the locking mechanism includes an actuator arm pivotally attached to the mount and having a first arm portion, the actuator arm rotatable between a first position in which the first arm portion is rotated towards a first end portion of the slot and a second position in which the first arm portion is rotated away from the slot, the sliding member being translatable along the slot when the actuator arm is in the second position.

12. The access door assembly of claim 11, wherein when the compound joint connection forms the fourth revolute joint connection, the sliding member is positioned at the first end portion of the slot and the actuator arm is in the first position such that the first arm portion holds the sliding member at the first end portion of the slot to allow the access door to rotate about the sliding member without the sliding member traveling along the slot as the access door moves between the lowered open position and the raised open position.

13. The access door assembly of claim 11, further comprising a biasing member coupled between the actuator arm and the mount for biasing the actuator arm to the first position.

14. The access door assembly of claim 11, further comprising a ledge projecting from the mount along at least a portion of a perimeter of the slot, wherein when the compound joint connection forms the fourth revolute joint connection, the first arm portion of the actuator arm is biased against the ledge holding the actuator arm in the first position.

15. The access door assembly of claim 11, wherein the actuator arm has a second end opposite the first end thereof, the second end having a cam surface that is positioned to engage a guide surface of the housing when the access door moves from the lowered open position to the raised closed position so as to rotate the actuator arm towards the second position and allow the compound joint connection to form the prismatic joint connection.

16. The access door assembly of claim 9, further comprising a handle disposed adjacent to an upper edge of the access door, wherein with the access door in the lowered open position and the compound joint connection forming the prismatic joint connection, a user-supplied actuation force less than or equal to 22.2 N applied to the handle pivots the access door toward the raised closed position.

17. An imaging device, comprising:

a frame;

a housing mounted on the frame and having an opening to receive one or more customer replaceable units;

an access door movably mounted on the frame for covering the opening, the access door movable between a raised closed position and a lowered open position when respectively latching and unlatching the access door relative to the housing, and between the lowered open position and a raised open position when partially closing and fully opening the access door relative to the opening, respectively, the access door substantially covering the opening when in the raised closed position, is pivoted open about a pivot axis adjacent to a bottom edge thereof partially exposing an upper portion of the opening when in the lowered open position, and is raised above the opening when in the raised open position; and, a four-bar linkage connected between the access door and the housing, the four-bar linkage including:

a pair of lower links connected to the access door and having respective first revolute joints at respective first attachment points; and a pair of upper links connected to the access door and having compound joints at respective second attachment points, each compound joint transformable between a prismatic joint and a second revolute joint as the access door moves between the raised closed position, the lowered open position, and the raised open position;

wherein:

when latching and unlatching the access door, the first revolute joints at the respective first attachment points define the pivot axis about which the access door pivots and each compound joint provides the prismatic joint to allow translational motion of the access door relative to the pair of upper links at the respective second attachment points as the access door moves between the raised closed position and the lowered open position; and when fully opening and partially closing the access door relative to the opening, each compound joint provides the second revolute joint to allow rotational motion of the access door relative to the pair of upper links at the respective second attachment points as the access door moves between the lowered open position and the raised open position.

18. The imaging device of claim 17, wherein when the access door moves between the raised closed position and the lowered open position, the first revolute joints at the respective second attachment points of the pair of lower links define the pivot axis about which the access door pivots, and the compound joints at the respective second attachment points of the pair of upper links form the respective prismatic joints which allow translational motion of the access door relative to the pair of upper links as the access door pivots about the first revolute joints.

19. The imaging device of claim 17, wherein when the access door moves between the lowered open position and the raised open position, the access door rotates about the first revolute joints at the respective first attachment points of the pair of lower links and the compound joints at the respective second attachment points of the pair of upper links form the respective second revolute joints which allow rotational motion of the access door relative to the pair of upper links as the access door rotates about the first revolute joints.

20. The imaging device of claim 17, further comprising a pair of mounts respectively attached adjacent to opposite sides of the access door with each mount having a slot formed in a body thereof, each compound joint connection including:

a sliding member coupled to a corresponding upper link at the second attachment point and passing through and slidable along the slot; and, a locking mechanism attached to the mount for locking out linear motion of the sliding member along the slot to form the second revolute joint and unblocking the linear motion of sliding member along the slot to form the prismatic joint.

* * * * *